US008827581B2

(12) United States Patent
Tsuchiya et al.

(10) Patent No.: US 8,827,581 B2
(45) Date of Patent: Sep. 9, 2014

(54) PRINTER AND METHOD OF CONTROLLING PRINTER

(75) Inventors: Masahiro Tsuchiya, Tokyo (JP); Tetsuhiro Ishikawa, Tokyo (JP); Sumio Watanabe, Tokyo (JP); Masaru Kihara, Tokyo (JP); Yukihiro Mori, Tokyo (JP)

(73) Assignee: Fujitsu Component Limited, Tokyo (JP)

( * ) Notice: Subject to any disclaimer, the term of this patent is extended or adjusted under 35 U.S.C. 154(b) by 148 days.

(21) Appl. No.: 13/477,695

(22) Filed: May 22, 2012

(65) Prior Publication Data

US 2012/0308288 A1 Dec. 6, 2012

(30) Foreign Application Priority Data

Jun. 2, 2011 (JP) ..... 2011-124515
Oct. 13, 2011 (JP) ..... 2011-226263

(51) Int. Cl.

| | |
|---|---|
| ***B65H 35/04*** | (2006.01) |
| ***B41J 15/04*** | (2006.01) |
| ***B41J 11/70*** | (2006.01) |
| ***B41J 2/32*** | (2006.01) |
| ***B41J 13/10*** | (2006.01) |

(52) U.S. Cl.

CPC .. *B41J 15/04* (2013.01); *B41J 2/32* (2013.01); *B41J 13/106* (2013.01); *B41J 11/70* (2013.01)
USPC ..... 400/621; 271/306

(58) Field of Classification Search

CPC ..... B65H 35/04; B65H 35/00; B41J 13/08; B41J 15/04; B41J 11/70
USPC ..... 400/621–621.2
See application file for complete search history.

(56) References Cited

U.S. PATENT DOCUMENTS

| | | | | |
|---|---|---|---|---|
| 5,954,438 | A * | 9/1999 | Klein et al. | 400/621 |
| 6,270,270 | B2 * | 8/2001 | Koshi et al. | 400/621 |
| 6,547,464 | B1 | 4/2003 | Lewis et al. | |
| 6,814,515 | B2 * | 11/2004 | Tsuchiya et al. | 400/621 |
| 2002/0018685 | A1 * | 2/2002 | Aruga et al. | 400/582 |
| 2003/0177928 | A1 * | 9/2003 | Harris | 101/484 |
| 2004/0165928 | A1 * | 8/2004 | Harris | 400/635 |
| 2007/0104527 | A1 | 5/2007 | Watanabe et al. | |
| 2009/0091077 | A1 * | 4/2009 | Ito | 271/278 |
| 2009/0212086 | A1 * | 8/2009 | Ito | 226/196.1 |
| 2010/0054839 | A1 * | 3/2010 | Sakai | 400/621 |
| 2012/0302325 | A1 * | 11/2012 | Meyerhofer et al. | 463/25 |
| 2014/0119806 | A1 * | 5/2014 | Ishikawa et al. | 400/621 |

FOREIGN PATENT DOCUMENTS

| | | | | |
|---|---|---|---|---|
| EP | 2045086 | | 4/2009 | |
| JP | 2000229760 | A * | 8/2000 | B65H 29/70 |
| JP | 2003-019845 | | 1/2003 | |
| JP | 2007-130842 | | 5/2007 | |
| KR | 10-2007-0073260 | | 7/2007 | |
| KR | 10-2007-0100493 | | 10/2007 | |

* cited by examiner

*Primary Examiner* — Nguyen Ha
(74) *Attorney, Agent, or Firm* — IPUSA, PLLC

(57) ABSTRACT

A printer includes a printing part configured to perform printing on rolled recording paper, a presenter unit configured to convey the recording paper for up to a predetermined length, and a cutter part configured to cut the recording paper subjected to the printing and conveyed for up to the predetermined length, wherein the presenter unit is removably attached to a printer body part including the printing part and the presenter unit.

16 Claims, 22 Drawing Sheets

PRINTER AND METHOD OF CONTROLLING PRINTER

CROSS-REFERENCE TO RELATED APPLICATIONS

The present application is based upon and claims the benefit of priority of Japanese Patent Application No. 2011-124515, filed on Jun. 2, 2011, and Japanese Patent Application No. 2011-226263, filed on Oct. 13, 2011, the entire contents of which are incorporated herein by reference.

BACKGROUND OF THE INVENTION

1. Field of the Invention

The present invention relates to a printer and a method of controlling the printer.

2. Description of the Related Art

Printers that output paper slips such as receipts are widely used for shops' registers and automated teller machines (ATMs) or cash dispensers (CDs) in banks.

Such printers that output receipts contain rolled (a roll of) thermal paper serving as recording paper. Printing is performed on the recording paper with a thermal head while conveying the recording paper. After conveying the recording paper a predetermined length, the recording paper is cut with a cutter to the predetermined length.

Some of these printers that output receipts include a presenter in order to prevent recording paper from being pulled out during printing or cutting with a cutter. The presenter is provided so that the recording paper subjected to printing enters the presenter to be cut and thereafter discharged from the presenter.

In addition to a function as a presenter, some presenters have a function as a retractor in order to prevent discharged recording paper, that is, a printed receipt or the like, that has been left behind, from being taken away by others.

For related art, reference may be made to Japanese Laid-Open Patent Application No. 2003-19845 and Japanese Laid-Open Patent Application No. 2007-130842.

SUMMARY OF THE INVENTION

According to an aspect of the invention, a printer includes a printing part configured to perform printing on rolled recording paper; a presenter unit configured to convey the recording paper for up to a predetermined length; and a cutter part configured to cut the recording paper subjected to the printing and conveyed for up to the predetermined length, wherein the presenter unit is removably attached to a printer body part including the printing part and the presenter unit.

According to an aspect of the invention, a printer includes a printing part configured to perform printing on rolled recording paper; a presenter unit configured to convey the recording paper for up to a predetermined length; a cutter part configured to cut the recording paper subjected to the printing and conveyed for up to the predetermined length; and a bezel connecting the presenter unit and a printer body part including the printing part and the presenter unit.

According to an aspect of the invention, a method of controlling a printer includes feeding, by a presenter unit, recording paper subjected to printing and cut to a predetermined length to a position where the cut recording paper is allowed to be taken out from a first paper discharge opening part in a bezel; and after passage of a predetermined period of time since the recording paper is fed to the position, feeding, by the presenter unit, the recording paper in a direction opposite to a direction in which the recording paper is fed to the position and discharging the recording paper from the bezel through a second paper discharge opening in the bezel.

The object and advantages of the embodiments will be realized and attained by means of the elements and combinations particularly pointed out in the claims.

It is to be understood that both the foregoing general description and the following detailed description are exemplary and explanatory and not restrictive of the invention as claimed.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

Figure 1:
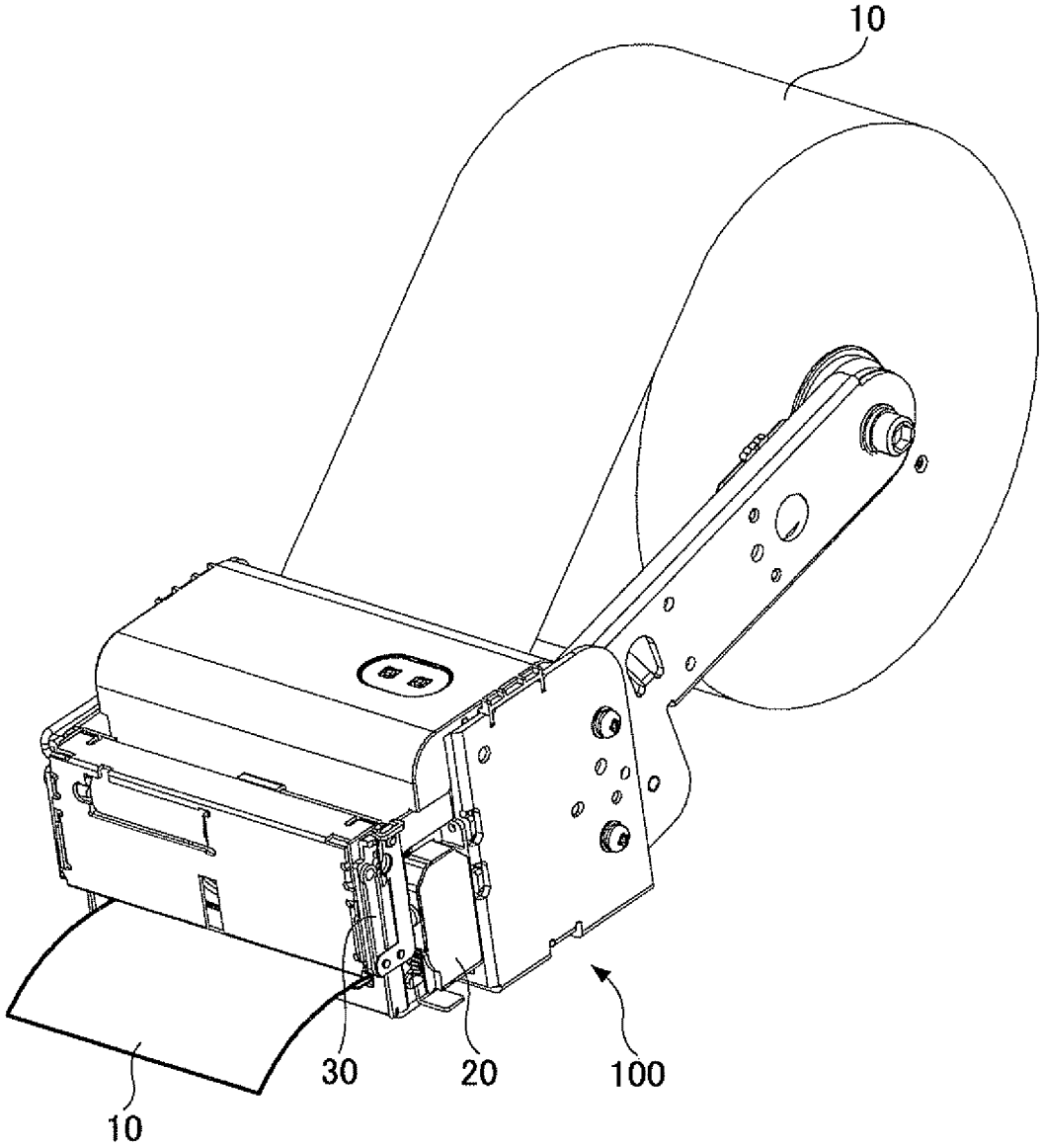
FIG. 1 is a perspective view of a printer according to an embodiment, where a presenter unit is not attached.

The above-described presenters vary in implementation. For example, some presenters employ the technique of causing recording paper to bend before its entry into a discharge opening for discharging the recording paper by conveying (feeding) the recording paper with its leading edge held at the discharge opening. According to this technique, however, the bent recording paper is unstable. Therefore, the recording paper may come into contact with various parts inside the presenter to get dirty, be crooked, or be damaged.

Further, there is the technique of rolling up recording paper around a rolling-up member after printing, and thereafter cutting the recording paper with a cutter and discharging the cut recording paper.

According to these conventional techniques, however, the rolling-up member may have a complicated mechanism or become larger in size.

Further, a paper roll is used for recording paper. Therefore, since the recording paper is rolled up, the degree of curling of the recording paper differs between the center and the periphery of the roll. As a result, the recording paper is strongly curled in the center of the roll, so that there is a problem in that such strong curling remains in a discharged receipt or the like.

Further, in the case of performing printing with a printer, the presenter function is required in some cases and is not required in other cases. Therefore, it is desired to determine whether to use the presenter function depending on the purpose of use. Further, it is also desired to reduce the size of the presenter.

According to an aspect of the present invention, a printer is provided that allows detachment and reattachment of a presenter, is reduced in size, is prevented from damaging recording paper, and is less likely to have the curl of a paper roll remaining in the recording paper.

According to an aspect of the present invention, a printer and a method of controlling a printer are provided that allow conveyance of recording paper such as a receipt to be controlled with ease.

A description is given below, with reference to the accompanying drawings, of embodiments of the present invention. In the following, the same elements as those already described are referred to by the same reference numerals, and a description thereof is omitted.

Figure 2:
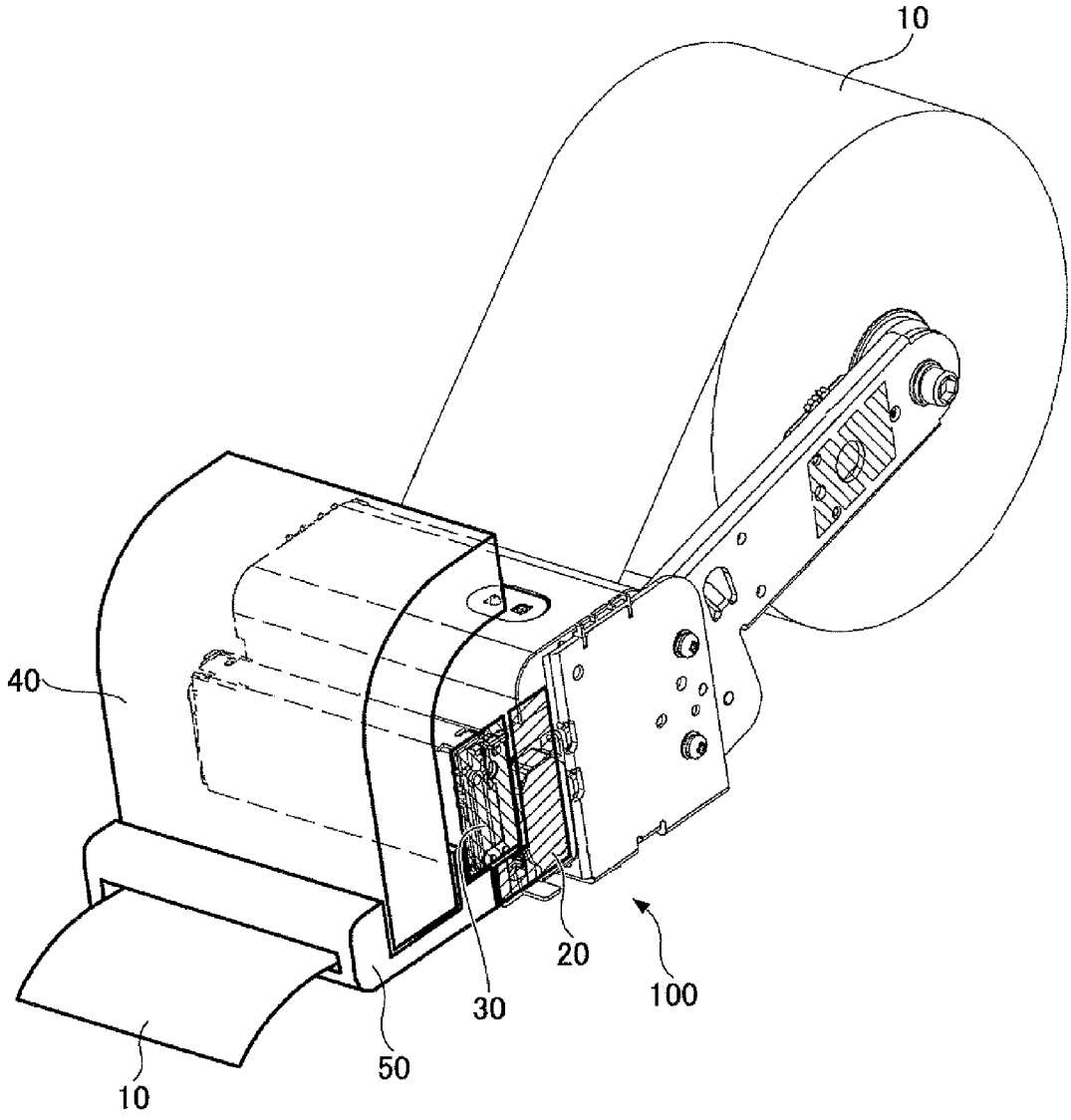
FIG. 2 is a perspective view of the printer according to the embodiment, where the presenter unit is attached.

First, a description is given, with reference to FIG. 1 and FIG. 2, of a structure of a printer according to an embodiment.

The printer of this embodiment includes a printer body part 100. The printer body part 100 includes a printing part 20 configured to print letters or characters on rolled recording paper 10 and a cutter part 30 configured to cut off a piece of the recording paper 10 subjected to printing. Hereinafter, a piece (portion) subjected to printing is referred to as "printed piece." The printed piece of the recording paper 10 has a predetermined length. Therefore, in the case of simply performing printing on recording paper and cutting the recording paper to a predetermined length, the configuration illustrated in FIG. 1 may be sufficient. According to this embodiment, in order to support the case where there is a need for a presenter function and a retractor function, the printer further includes a presenter unit 40 (FIG. 2). The presenter unit 40 is detachably (and reattachably) attached to the printer body part 100 via a bezel 50, which is provided where the recording paper 100 is discharged (ejected).

Figure 3:
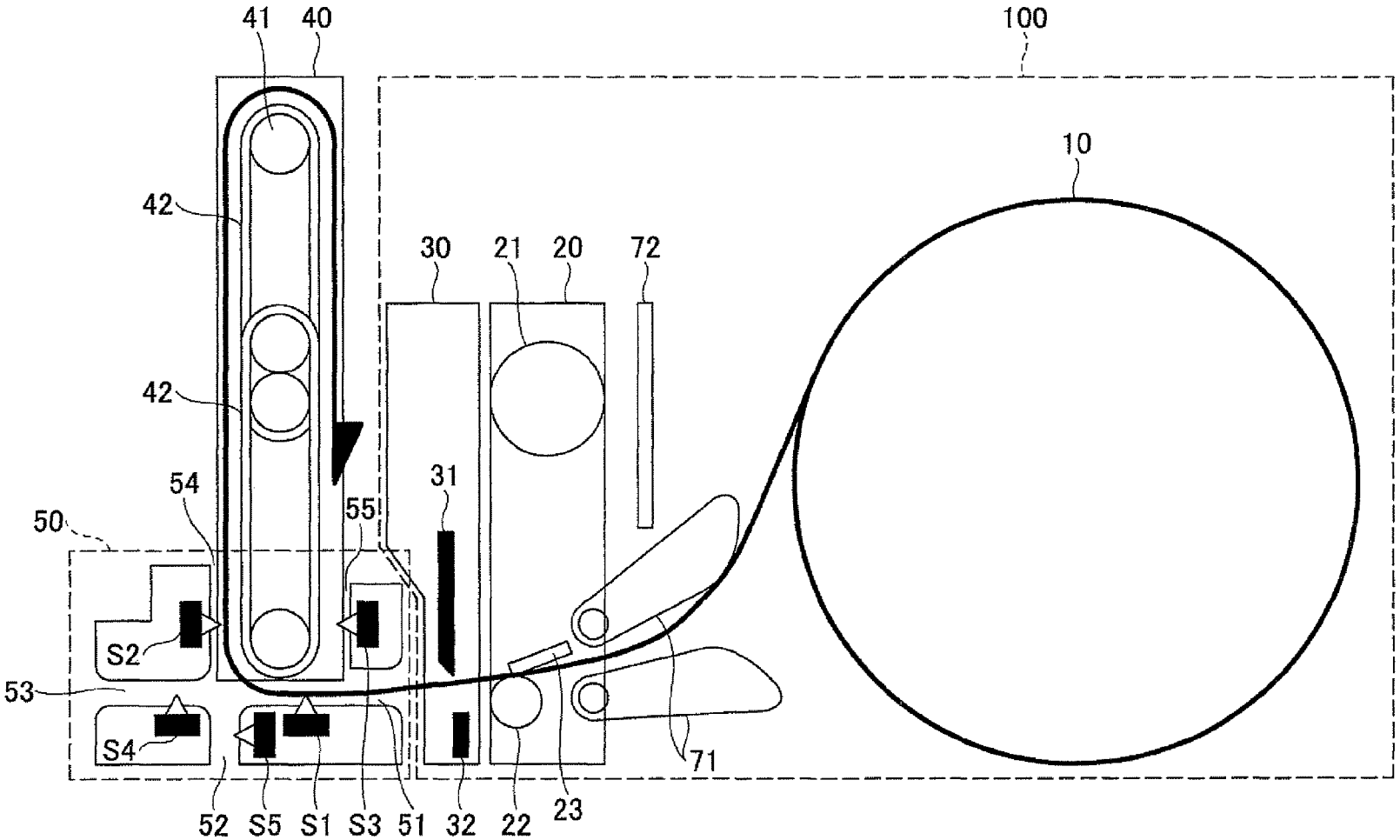
FIG. 3 is a diagram illustrating a structure of the printer according to the embodiment, where the presenter unit is attached.

Next, a description is given of the presenter function and the retractor function of the presenter unit 40 in the printer according to this embodiment. FIG. 3 is a structural diagram illustrating the printer according to this embodiment, where the presenter unit 40 is connected (attached) to the printer body part 100.

Referring to FIG. 3, the printer body part 100 further includes a buffer mechanism part 71 and a control circuit part 72 including a control circuit. As illustrated in FIG. 3, the rolled recording paper 10 (in the form of a paper roll) enters the printing part 20 through the buffer mechanism part 71, for example. The control circuit part 72, which includes a processor or a central processing unit (CPU), a memory, etc., performs control in the printing part 20, the cutter part 30, the presenter unit 40, and the bezel 50.

The printing part 20 includes a first motor 21, a platen roller 22, and a thermal head 23. The first motor 21 causes the recording paper 10 to be conveyed (fed). The rotation of the first motor 21 is transmitted to the platen roller 22, so that the platen roller 22 rotates to convey the recording paper 10. The thermal head 23 applies heat to the recording paper 10, which may be thermal paper, in accordance with printing information, so that printing is performed on the conveyed recording paper 10. The platen roller 22 rotates so that the recording paper 10 subjected to printing is conveyed from the printing part 20 to pass through the cutter part 30 and thereafter enters the presenter unit 40 through the bezel 50.

The cutter part 30 includes a movable blade 31 and a stationary blade 32. The movable blade 31 is caused to move downward so that the recording paper 10 is cut to a predetermined length with the movable blade 31 and the stationary blade 32.

The presenter unit 40 includes multiple conveying gears and a conveyor belt attached to two of the conveying gears. The conveying gears rotate to move the conveyor belt, so that the recording paper 10 is conveyed by the conveyor belt. In the case illustrated in FIG. 3, by way of example, four conveying gears 41 are provided, and conveyor belts 42 are attached to respective two of the conveying gears 41. That is, two sets of the conveyor belt 42 and the corresponding conveying gears 41 are provided.

Figure 4:
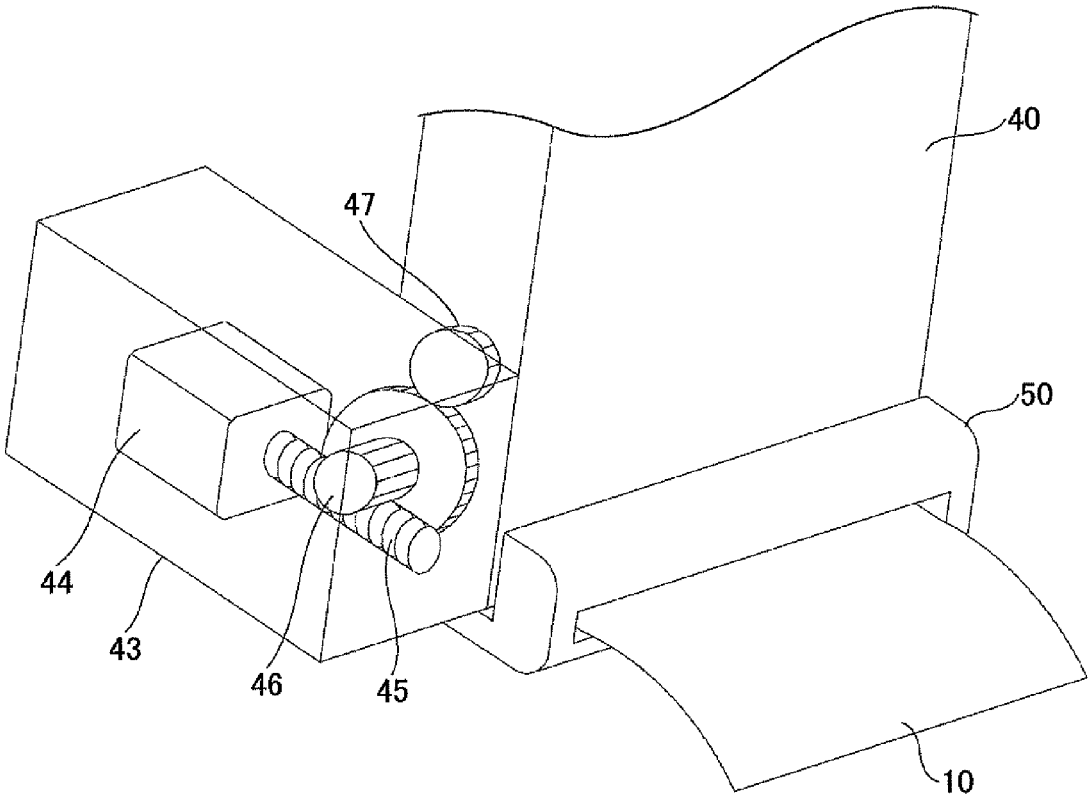
FIG. 4 is a diagram illustrating a configuration of the presenter unit according to the embodiment.

Referring to FIG. 4, the presenter unit 40 may further include a rotary drive module part 43 configured to rotate the conveying gears 41 (FIG. 3). For example, the rotary drive module part 43 includes a second motor 44. The rotation of the second motor 44 is transmitted to a first transmission gear 46 via a rotary part 45 to be further transmitted to a second transmission gear 47 engaged with the first transmission gear 46. This allows the rotation of the second transmission gear 47 to be transmitted to the conveying gears 41 illustrated in FIG. 3 to cause the conveyor belts 42 to move. A (helical) groove corresponding to the first transmission gear 46 is formed on the rotary part 45, so that the groove of the rotary part 45 is engaged with the first transmission gear 46.

Referring to FIG. 3, the bezel 50 includes an entrance opening part 51 through which the recording paper 10 enters the bezel 50 from the cutter part 30; a paper discharge opening part 52 through which the retracted recording paper 10 is discharged from the bezel 50; a paper discharge opening part 53 through which the cut recording paper 10 is usually discharged from the bezel 50; a presenter entrance part 54 (a first gap) through which the recording paper 10 enters the presenter unit 40; and a presenter exit part 55 (a second gap) through which the recording paper 10 exits the presenter unit 40. According to this embodiment, the entrance opening part 51 and the paper discharge opening part 53 are substantially aligned with each other or arranged with a positional relationship close to a straight line. This allows the recording paper 10 that enters the bezel 50 from the cutter part 30 through the entrance opening part 51 to be discharged to the paper discharge opening part 53 also in the case where the presenter unit 40 is removed from the bezel 50.

According to this embodiment, the presenter entrance part 54 and the presenter exit part 55 are formed by inserting the presenter unit 40 into a predetermined portion of the bezel 50. Further, the bezel 50 includes a first sensor S1, a second sensor S2, a third sensor S3, a fourth sensor S4, and a fifth sensor S5. The first sensor S1 detects the recording paper 10 that has entered the entrance opening part 51. The second sensor S2 detects the recording paper 10 that has entered the presenter entrance part 54. The third sensor S3 detects the recording paper 10 in the presenter exit part 55. The fourth sensor S4 detects the recording paper 10 that has entered the paper discharge opening part 53. The fifth sensor S5 detects the recording paper 10 that has entered the paper discharge opening part 52. According to the printer of this embodiment, it is possible to detect (the presence or absence of) the connection of the presenter unit 40 to the bezel 50 using the second sensor S2 and the third sensor S3.

Next, a description is given, with reference to FIGS. 5A through 5E, of operations of the presenter unit 40. In the case illustrated in FIGS. 5A through 5E, the presenter unit 40 includes three sets of the conveyor belt 42 and the corresponding conveying gears 41. As described above, however, the same applies to the case of one, two or four sets of the conveyor belt 42 and the corresponding conveying gears 41.

Figure 5A:
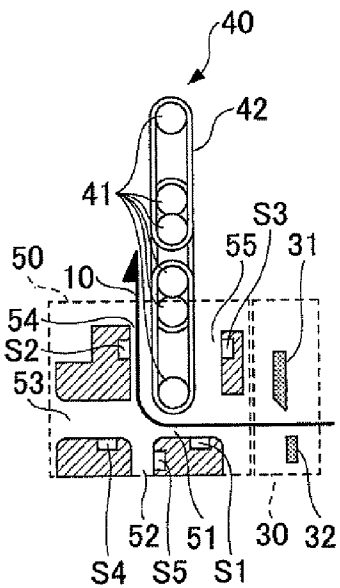
FIGS. 5A through 5E are diagrams illustrating the presenter unit according to the embodiment.

First, as illustrated in FIG. 5A, the recording paper 10 subjected to printing in the printing part 20 passes through the cutter part 30 to enter the bezel 50 through the entrance opening part 51 and further enter the presenter unit 40 through the presenter entrance part 54. In this state, the conveying gears 41 rotate so that the recording paper 10 is conveyed by the conveyor belts 42.

Figure 5B:
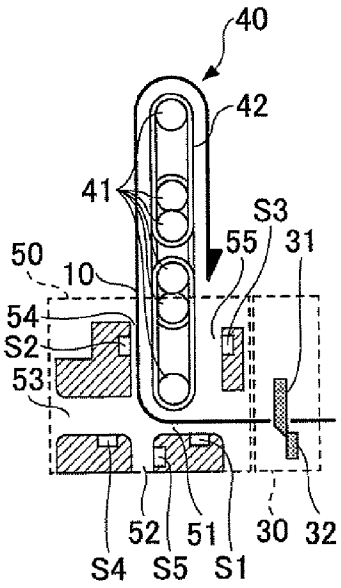

Next, as illustrated in FIG. 5B, after being conveyed a predetermined length (distance) by the conveyor belts 42, the recording paper 10 is cut with the movable blade 31 and the stationary blade 32 in the cutter part 30.

Figure 5C:
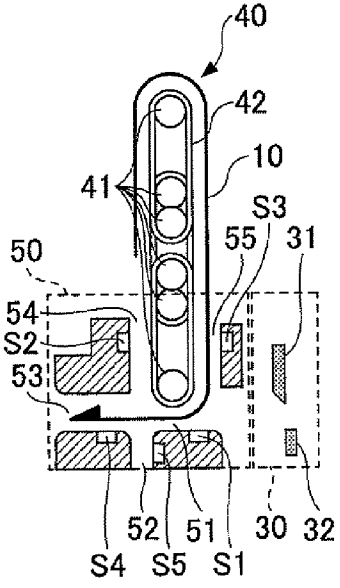
Figure 5D:
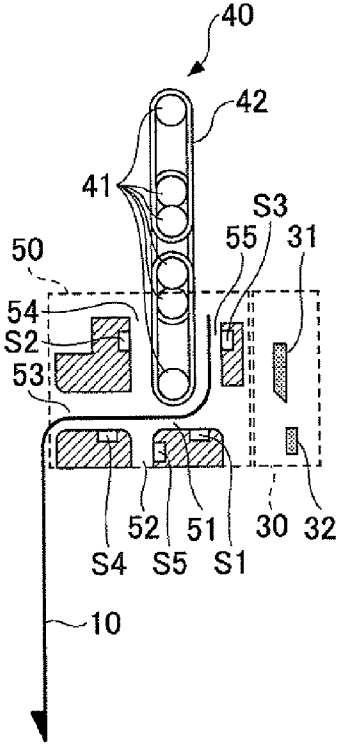

Next, as illustrated in FIG. 5C, (the cut piece of) the recording paper 10 is further conveyed to go toward the paper discharge opening part 53 through the presenter exit part 55, and the conveyance of the recording paper 10 stops at a predetermined position. In this state, the recording paper 10 has been cut. Therefore, the recording paper 10 may be taken out as illustrated in FIG. 5D by being manually pulled out at the paper discharge opening part 53.

Figure 5E:
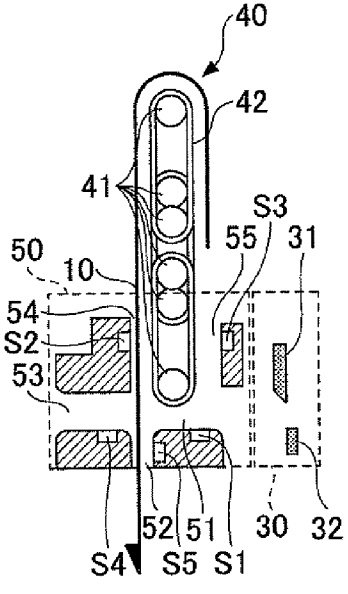

The state illustrated in FIG. 5C is maintained for a predetermined period of time. However, after passage of the predetermined period of time, it is determined that a person supposed to receive the recording paper 10 has forgotten to take the recording paper 10. Therefore, the presenter unit 40 starts a retracting operation to prevent the recording paper 10 on which printing has been performed from being taken away by others. This retracting operation is performed by causing the conveying gears 41 to rotate in the reverse direction. For example, the recording paper 10 is conveyed on the conveyor belts 42 in the direction reverse to that of the conveying operation in FIGS. 5A through 5C. As a result, as illustrated in FIG. 5E, the recording paper 10 is conveyed in the reverse direction by the conveyor belts 42 to be discharged from the paper discharge opening part 52 through the presenter entrance part 54.

Next, a description is given of the recurling of the recording paper 10 in the presenter unit 40. According to the printer of this embodiment, the curl of the recording paper 10 may be reduced or eliminated by recurling the recording paper 10 by bending the recording paper 10 in the direction opposite to the curling direction of the rolled recording paper 10 in the presenter unit 40. That is, the recording paper 10 is curled in a direction to reduce or eliminate the curl of the roll of the recording paper 10.

Figure 6A:
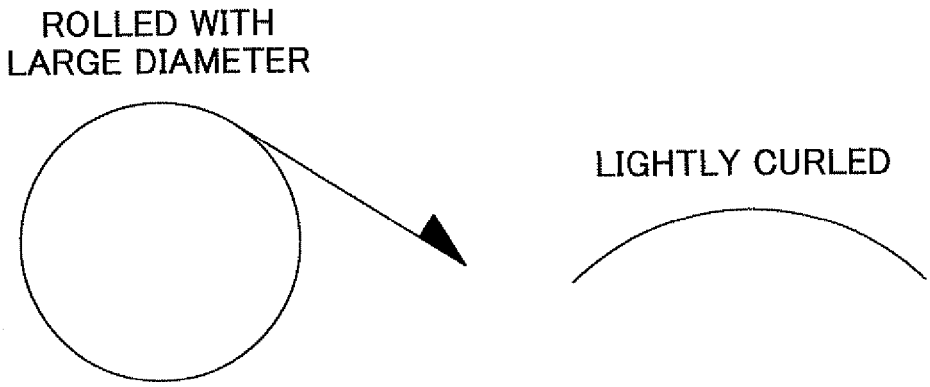
FIGS. 6A through 6C are diagrams illustrating curling of recording paper.
Figure 6B:
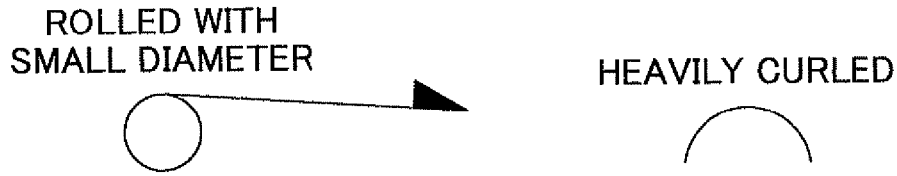
Figure 6C:
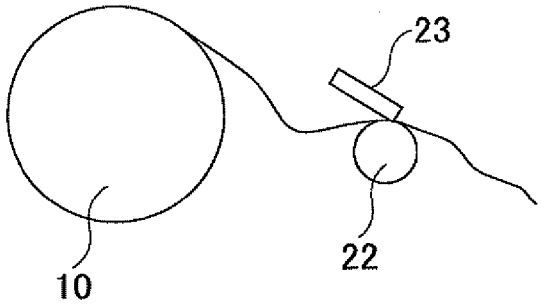

This recurling operation is described with reference to FIGS. 6A through 6C. As illustrated in FIG. 6A, the rolled recording paper 10 has a large curvature radius in an initial (leading) portion. Therefore, the initial portion of the recording paper 10 is discharged with a light curl. On the other hand, as illustrated in FIG. 6B, the rolled recording paper 10 has a small curvature radius in a portion near its end. Therefore, the near-end portion of the recording paper 10 is discharged with a heavy curl (so that the discharged recording paper 10 curls up). The thus curled recording paper 10 is not recurled (that is, curled in the opposite direction) even when the recording paper 10 is caused to pass between the thermal head 23 and the platen roller 22 at the time of printing on the recording paper 10 as illustrated in FIG. 6C.

Figure 7B:
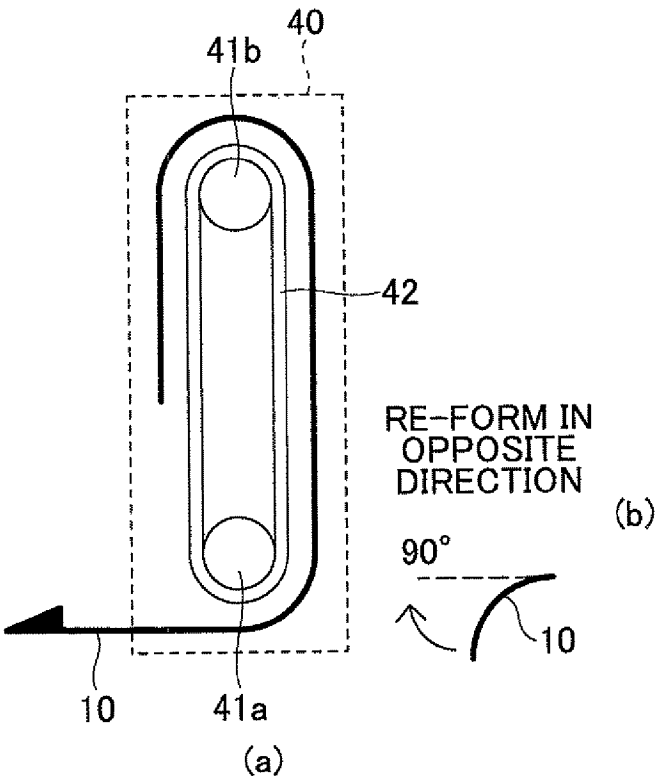
FIGS. 7A and 7B are diagrams illustrating recurling performed by the presenter unit according to the embodiment.
Figure 7A:
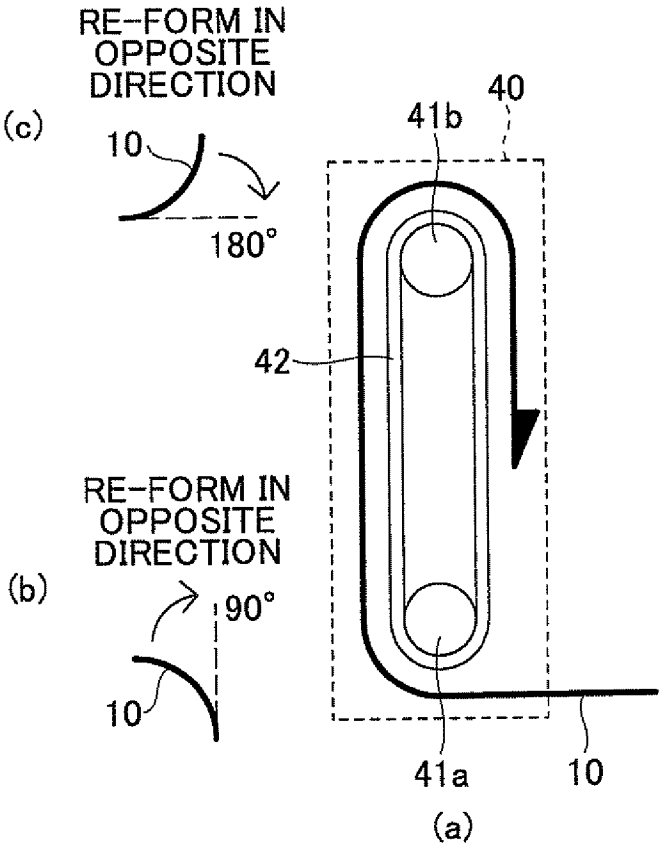

Therefore, according to this embodiment, the recording paper 10 is recurled by being bent in the direction opposite to its curling direction (in which the recording paper 10 is curled) as illustrated in FIGS. 7A and 7B. That is, as illustrated in (a) of FIG. 7A, the recording paper 10 enters the presenter unit 40 according to this embodiment to be bent 90° in the direction opposite to its curling direction via the conveyor belt 42 at a first conveying gear 41*a* (corresponding to one of the conveying gears 41 illustrated in, for example, FIG. 3). In FIG. 7A, (b) illustrates the recurling direction opposite to the curling direction of the recording paper 10 at the conveying gear 41*a*. Thereafter, the recording paper 10 is bent 180° in the direction opposite to its curling direction via the conveyor belt 42 at a second conveying gear 41*b* (corresponding to one of the conveying gears 41 illustrated in, for example, FIG. 3). In FIG. 7A, (c) illustrates the recurling direction opposite to the curling direction of the recording paper 10 at the conveying gear 41*b*.

Further, as illustrated in (a) of FIG. 7B, the recording paper 10 is bent 90° in the direction opposite to its curling direction via the conveyor belt 42 at the conveying gear 41*a*, and is discharged. In FIG. 7B, (b) illustrates the recurling direction opposite to the curling direction of the recording paper 10 at the conveying gear 41*a*. Thus, in the presenter unit 40, the recording paper 10 is recurled 360° in total in the direction opposite to the curling direction. As a result, the curling of the recording paper 10 is reduced, so that the recording paper 10 is allowed to be discharged without curling up.

Thus, according to this embodiment, the rolled recording paper 10 is recurled in the direction opposite to its curling direction. In other words, the recording paper 10 is recurled along the conveyor belt 42 on its printing surface side. This allows the recording paper 10 to be discharged without curling up.

Next, a description is given of a method of connecting the bezel 50 and the presenter unit 40. According to the printer of this embodiment, it is possible to detach the presenter unit 40 from and attach (reattach) the presenter unit 40 to the bezel 50. Connection (attachment) of the presenter unit 40 to the bezel 50 allows a presenter function and a retractor function to be executed in the presenter unit 40.

Figure 8B:
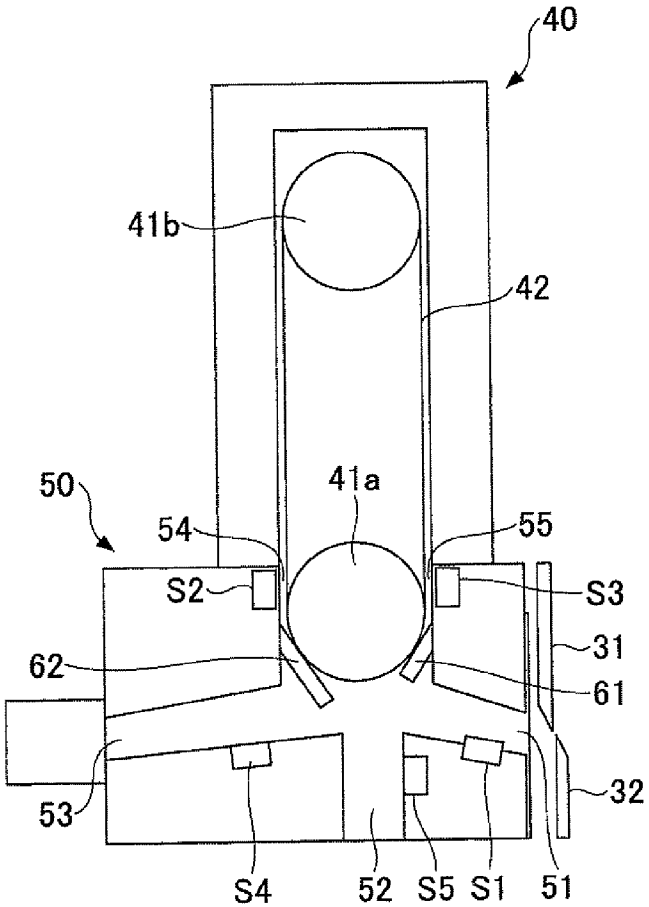
FIGS. 8A and 8B are diagrams illustrating a method of attaching the presenter unit according to the embodiment.
Figure 8A:
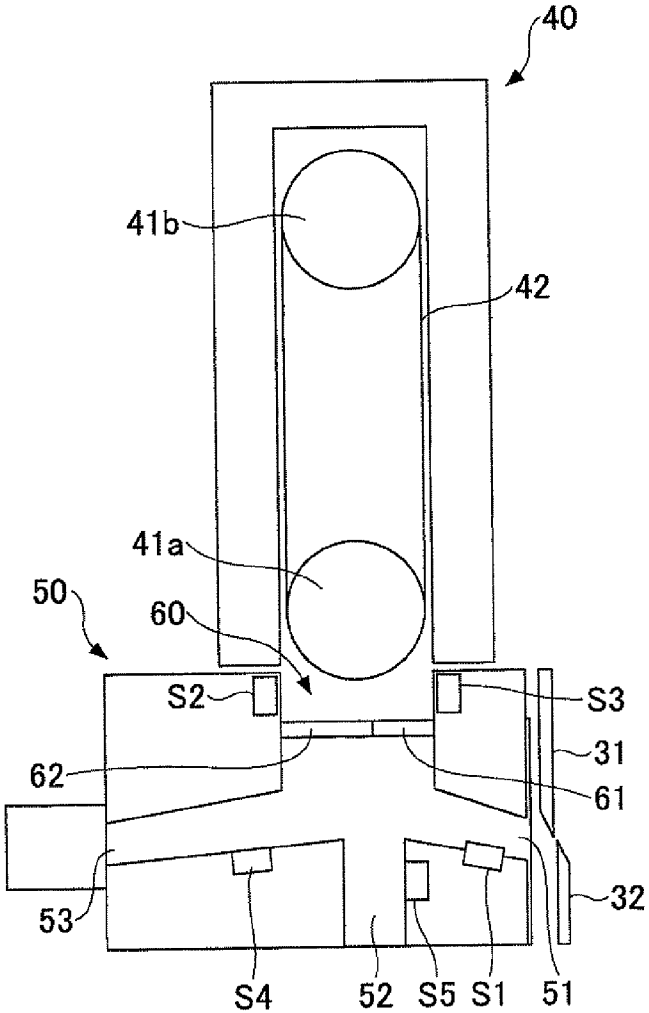

Therefore, as illustrated in FIGS. 8A and 8B, the bezel 50 includes a connection part 60 to which the presenter unit 40 is connected. The connection part 60 is provided with opening doors (door members) 61 and 62 configured to be closed when the presenter unit 40 is not connected to the connection part 60 and be opened when the presenter unit 40 is connected to the connection part 60. For example, the opening doors 61 and 62 may constitute a biparting swing door.

That is, as illustrated in FIG. 8A, when the presenter unit 40 is not connected to the connection part 60, the opening doors 61 and 62 included in the bezel 50 are closed to prevent dust and the like from entering part of the bezel 50 that the recording paper 10 passes through.

Next, as illustrated in FIG. 8B, when the presenter unit 40 is connected to the connection part 60 of the bezel 50, the opening doors 61 and 62 are pressed by the conveying gear 41*a* of the presenter unit 40 through the conveyor belt 42 to be open, so that the presenter unit 40 is connected to a predetermined position in the bezel 50. As a result, the presenter entrance part 54 and the presenter exit part 55 are formed. When the presenter unit 40 is removed from the bezel 50, the opening doors 61 and 62 are again closed by springs (not graphically illustrated) or the like as illustrated in FIG. 8A.

Figure 9:
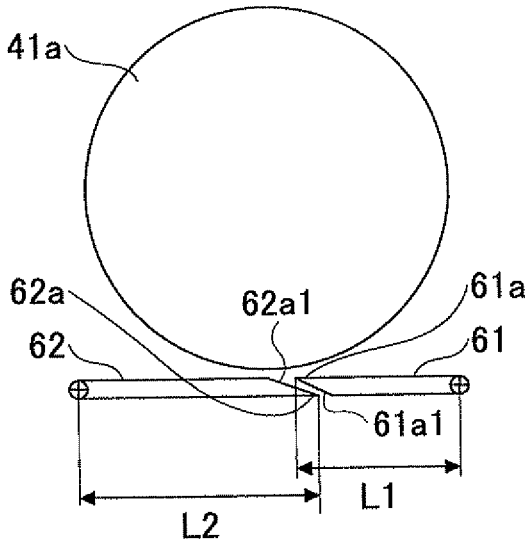
FIG. 9 is a diagram illustrating a structure of opening doors provided in a bezel according to this embodiment.

As illustrated in FIG. 9, in order to prevent entry of dust and the like, the opening doors 61 and 62 provided in the bezel 50 have respective end parts 61*a* and 62*a* obliquely cut or shaped to overlap each other. For example, the end parts 61*a* and 62*a* may be obliquely cut so that the opening doors 61 and 62 have respective end faces 61*a*1 and 62*a*1 face each other.

In the bezel 50, the end part 61*a* of the opening door 61 has, for example, an acute angle on the outer side (facing outward) or the side facing toward the presenter unit 40, and the end part 62*a* of the opening door 62 has, for example, an acute angle on the inner side (facing inward) or the side facing away from the presenter unit 40. Therefore, a length L1 of the opening door 61 (a length measured from the axis of rotation to the end part 61*a* of the opening door 61) is less (shorter) than a length L2 of the opening door 62 (a length measured from the axis of rotation to the end part 62*a* of the opening door 62). This is because if the opening door 62 closes earlier than the opening door 61, the end part 61*a* and the end part 62*a* collide with each other to prevent the opening doors 61 and 62 from being normally closed. Therefore, in order to prevent this, the length L1 is less than the length L2.

However, the opening and closing sequence (mechanism) is not limited to the one described above, and may be implemented by offsetting door positions or a differential drive system based on a difference in spring force. In FIG. 9, the conveyor belt 42 is omitted for convenience of graphical representation.

Figure 10A:
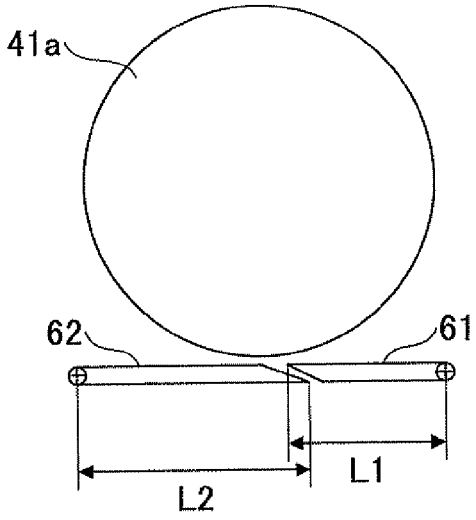
FIGS. 10A through 10C are diagrams illustrating an operation of the opening doors provided in the bezel according to the embodiment.
Figure 10B:
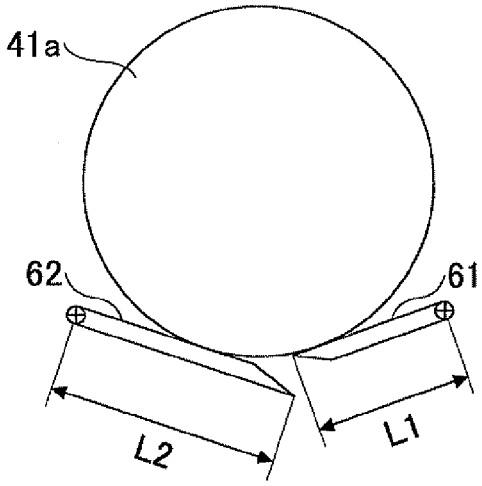
Figure 10C:
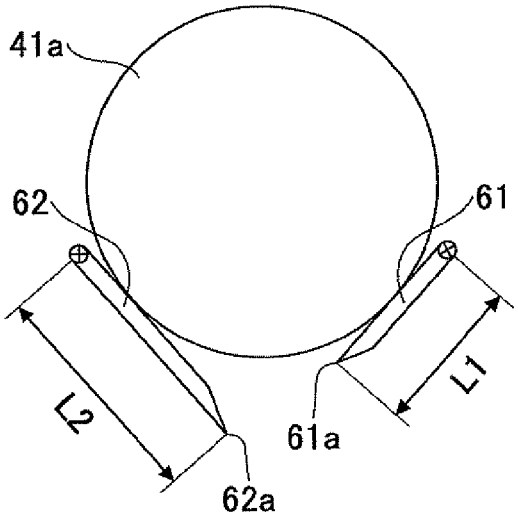

A description is given in more detail, with reference to FIGS. 10A through 10C, of operations of the opening doors 61 and 62.

As illustrated in FIGS. 10A through 10C, at the time of attaching the presenter unit 40 to the bezel 50, the conveying gear 41*a* pushes the opening doors 61 and 62 open. That is, at the time of connecting the presenter unit 40 to the bezel 50, the conveying gear 41*a* moves as illustrated in order of FIG. 10A to FIG. 10B to FIG. 10C to push the opening doors 61 and 62 open. At this point, since the length L2 of the opening door 62 is greater (longer) than the length L1 of the opening door 61, the end part 62*a* of the opening door 62 is positioned lower (farther from the conveying gear 41*a*) than the end part 61*a* of the opening door 61.

Further, in the case of removing the presenter unit 40 from the bezel 50, the conveying gear 41*a* moves as illustrated in order of FIG. 10C to FIG. 10B to FIG. 10A so that the opening doors 61 and 62 are closed. At this point, since the length L2 of the opening door 62 is greater than the length L1 of the opening door 61, the end part 62*a* of the opening door 62 is positioned lower (farther from the conveying gear 41*a*) than the end part 61*a* of the opening door 61. As a result, it is possible to prevent the opening door 62 from being closed earlier than the opening door 61. In FIG. 10, the conveyor belt 42 is omitted for convenience of graphical representation.

Further, the opening doors 61 and 62 also have a function as a guide in conveying the recording paper 10 on the conveyor belt 42 by the conveying gear 41*a*. For example, as illustrated in FIG. 8B, the recording paper 10 that has entered the bezel 50 through the entrance opening part 51 comes into contact with the opening door 62 operating as a guide to move along the surface of the opening door 62. Then, the recording paper 10 enters the presenter entrance part 54 to be wrapped around (placed on and along) the conveyor belt 42. Thereafter, the recording paper 10*a* placed along the conveyor belt 42 makes substantially one round on the conveyor belt 42 to move toward the paper discharge opening part 53 along the opening door 61 operating as a guide from the presenter exit part 55. Further, in the case of retracting the recording paper 10, the conveying gears 41*a* and 42*b* rotate in the reverse direction to feed the recording paper 10 in the opposite direction with the conveyor belt 42. As a result, the recording paper 10 moves along the opening door 62 to be discharged from the paper discharge opening part 52 provided between the entrance opening part 51 and the paper discharge opening part 53.

According to this embodiment, the entrance opening part 51 and the paper discharge opening part 53 are substantially aligned with each other or arranged with a positional relationship close to a straight line in the bezel 50. As a result, when the presenter unit 40 is not attached to the bezel 50, the recording paper 10 that enters the bezel 50 through the entrance opening part 51 is allowed to move substantially straight to be discharged from the paper discharge opening part 53. Further, the paper discharge opening part 52 is provided between the entrance opening part 51 and the paper discharge opening part 53 in order to prevent the recording paper 10 that has entered the bezel 50 from the entrance opening part 51 from erroneously entering the paper discharge opening part 52. For example, the paper discharge opening part 52 is positioned to be perpendicular to the entrance opening part 51 or to the paper discharge opening part 53.

Further, the connection part 60 is provided opposite the paper discharge opening part 52 between the entrance opening part 51 and the paper discharge opening part 53, and is substantially aligned or arranged with a positional relationship close to a straight line with the paper discharge opening part 52. Further, the presenter entrance part 54, formed by connecting the presenter unit 40 to the connection part 60 of the bezel 50, is substantially aligned with the paper discharge opening part 52, or is so formed as to allow the recording paper 10 to move toward the paper discharge opening part 52 from the presenter entrance part 54. That is, the presenter entrance part 54 is so formed as to allow the retracted recording paper 10 to smoothly move into the paper discharge opening part 52 from the presenter entrance part 54.

Figure 11B:
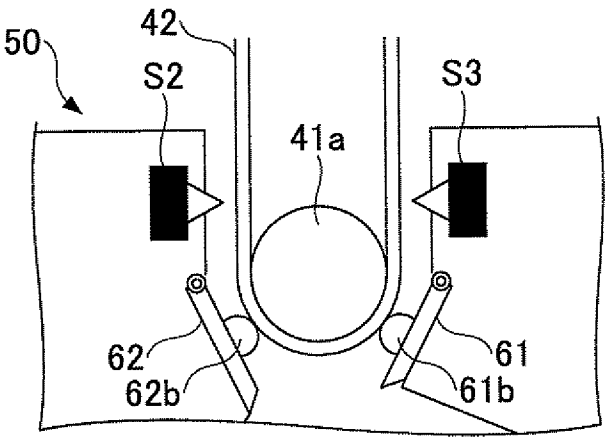
FIGS. 11A and 11B are diagrams illustrating another structure of the opening doors provided in the bezel according to the embodiment.
Figure 11A:
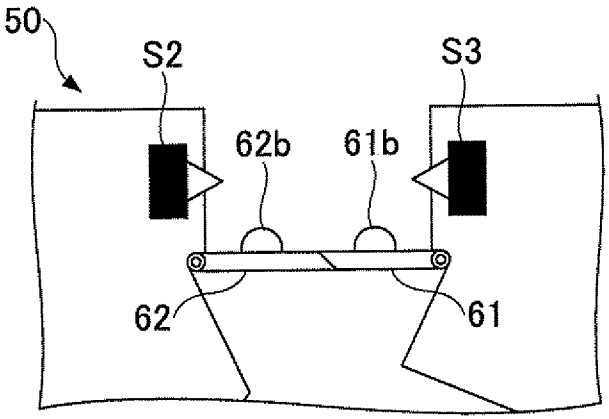

Further, in the bezel 50, projection parts 61*b* and 62*b* may be provided on parts of the opening doors 61 and 62, respectively, which parts come into contact with the conveying gear 41*a* of the presenter unit 40 through the conveyor belt 42 as illustrated in FIGS. 11A and 11B. The projection parts 61*b* and 62*b* may be replaced with pinch roller parts. FIG. 11A illustrates the opening doors 61 and 62 in a closed state. FIG. 11B illustrates the opening doors 61 and 62 that are opened by the conveying gear 41*a* through the conveyor belt 42.

Figure 12:
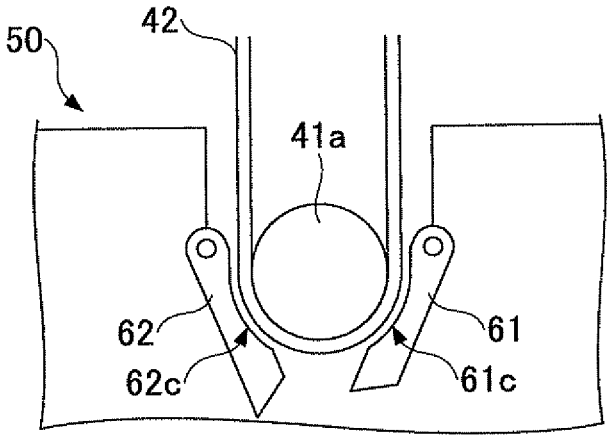
FIG. 12 is a diagram illustrating another structure of the opening doors provided in the bezel according to the embodiment.

Further, in the bezel 50, as illustrated in FIG. 12, recesses (depressed portions) 61*c* and 62*c* may be formed on parts of the opening doors 61 and 62, respectively, which parts come into contact with the conveying gear 41*a* of the presenter unit 40 through the conveyor belt 42. The recesses 61*c* and 62*c* are so formed as to correspond in shape to the conveying gear 41*a* with which the recesses 61*c* and 62*c* come into contact through the conveyor belt 42.

Figure 13:
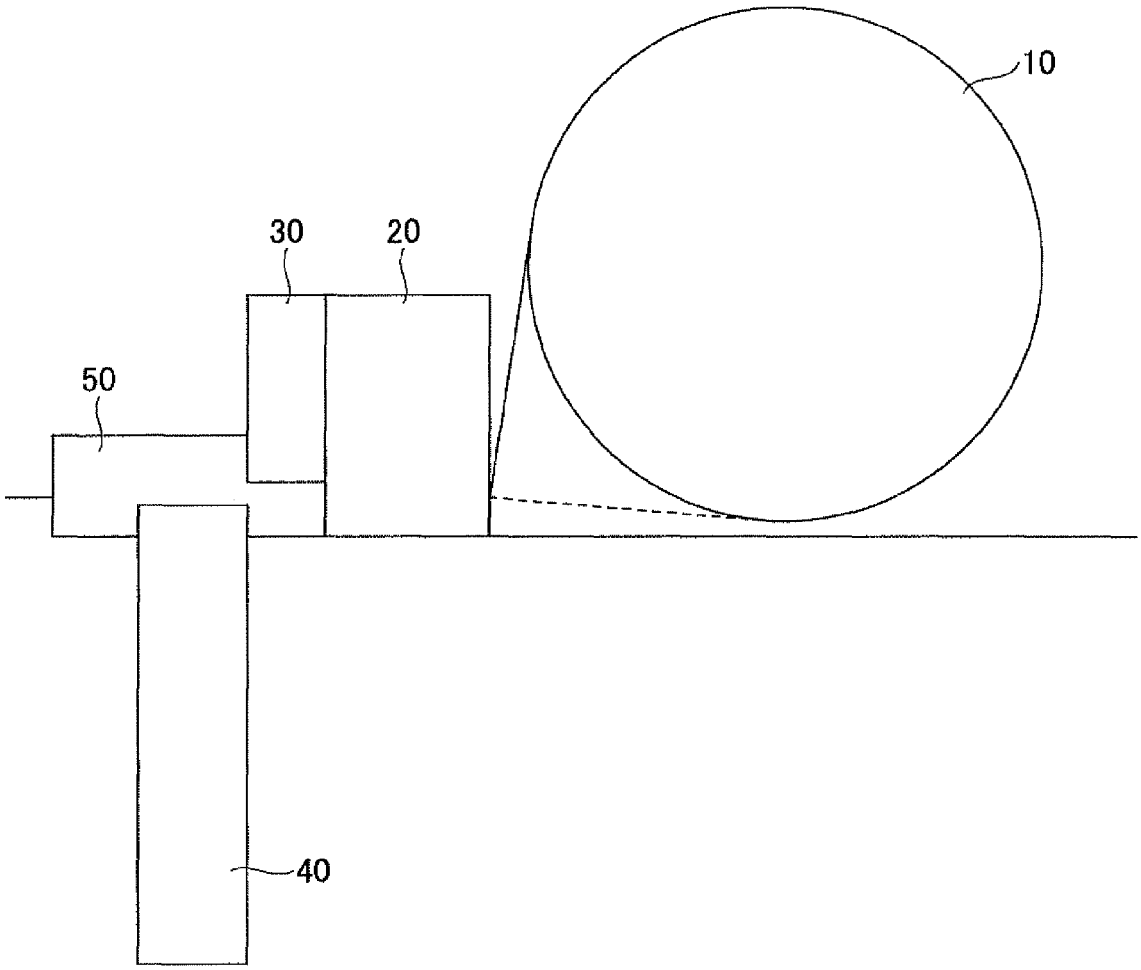
FIG. 13 is a diagram illustrating another structure of the printer according to the embodiment, where the presenter unit is attached.

FIG. 13 is a diagram illustrating another structure of the printer according to this embodiment, where the presenter unit 40 is attached to the bezel 50.

Figure 14:
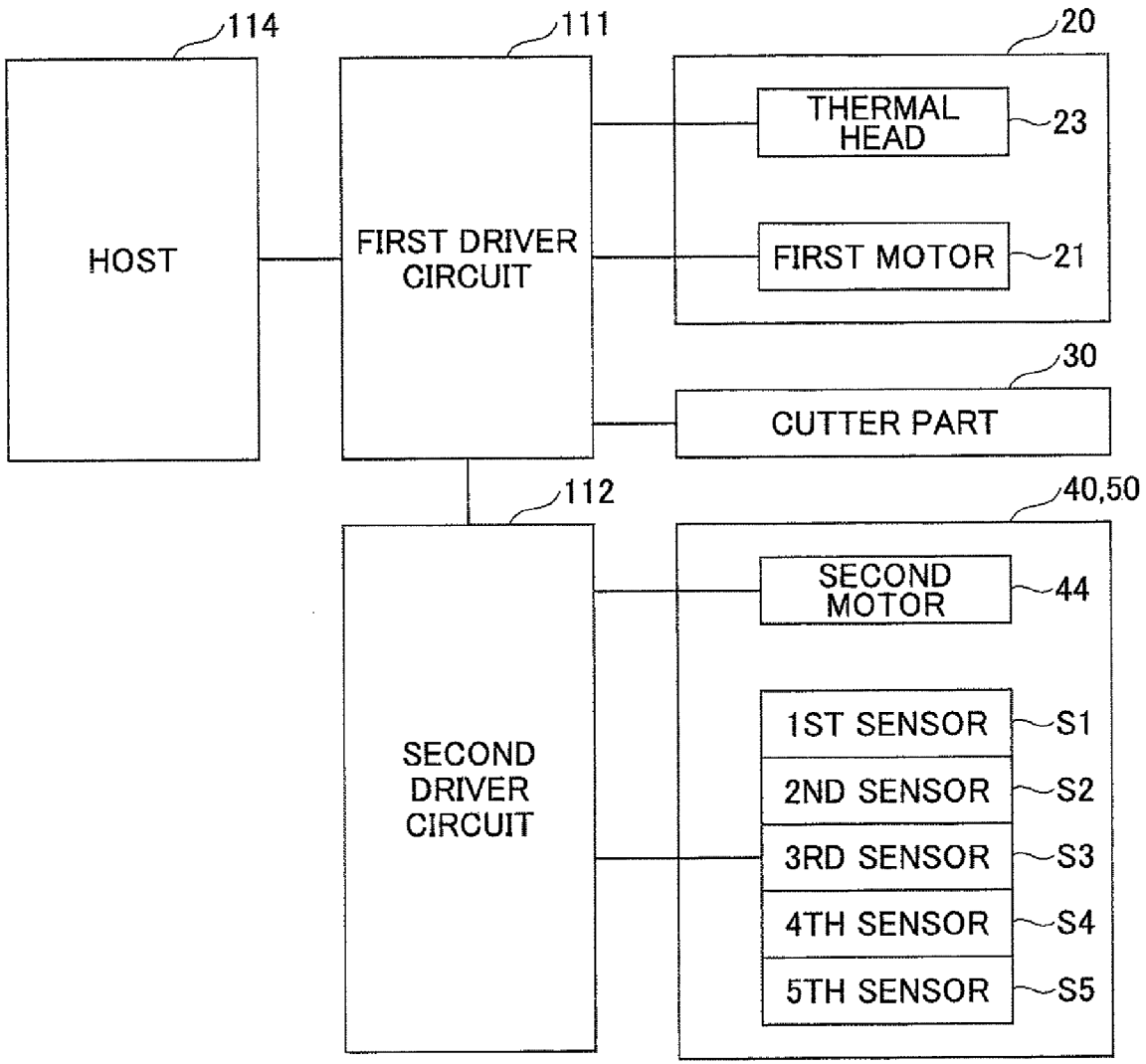
FIG. 14 is a block diagram illustrating a first embodiment of controlling the printer according to the embodiment.

Referring to FIG. 14, the printer according to this embodiment may also be structured so that the presenter unit 40 is provided on the side opposite to the recording paper 10 (relative to the paper conveyance path from the printing part 20 to the paper discharge opening part 53 of the bezel 50, for example). In this case, if the rolled recording paper 10 is so rolled as to have its printing surface facing inward as indicated by a broken line, it is possible to recurl the recording paper 10 in the presenter unit 40.

Next, a description is given, with reference to FIG. 14, of a first embodiment of controlling the printer of the above-described embodiment. According to the first embodiment, the printer includes a first driver circuit 111 and a second driver circuit 112. The first driver circuit 111 is configured to drive and control the printing part 20 and the cutter part 30. The second driver circuit 112 is configured to drive and control the presenter unit 40 and the bezel 50. The first driver circuit 111 is connected to a host (host computer) 113 for controlling the printer according to this embodiment, so that the first driver circuit 111 operates based on settings in and instructions from the host 113. The first motor 21 and the thermal head 23 of the printing part 20 and the cutter part 30 are connected to and driven and controlled by the first driver circuit 111. The second motor 44, the first sensor S1, the second sensor S2, the third sensor S3, the fourth sensor S4, and the fifth sensor S5 are connected to the second driver circuit 112. The second driver circuit 112 drives and controls the second motor 44. The second driver circuit 112 is connected to the first driver circuit 111, so that information such as settings and instructions in the host 113 is transmitted to the second driver circuit 112 via the first driver circuit 111.

Figure 15:
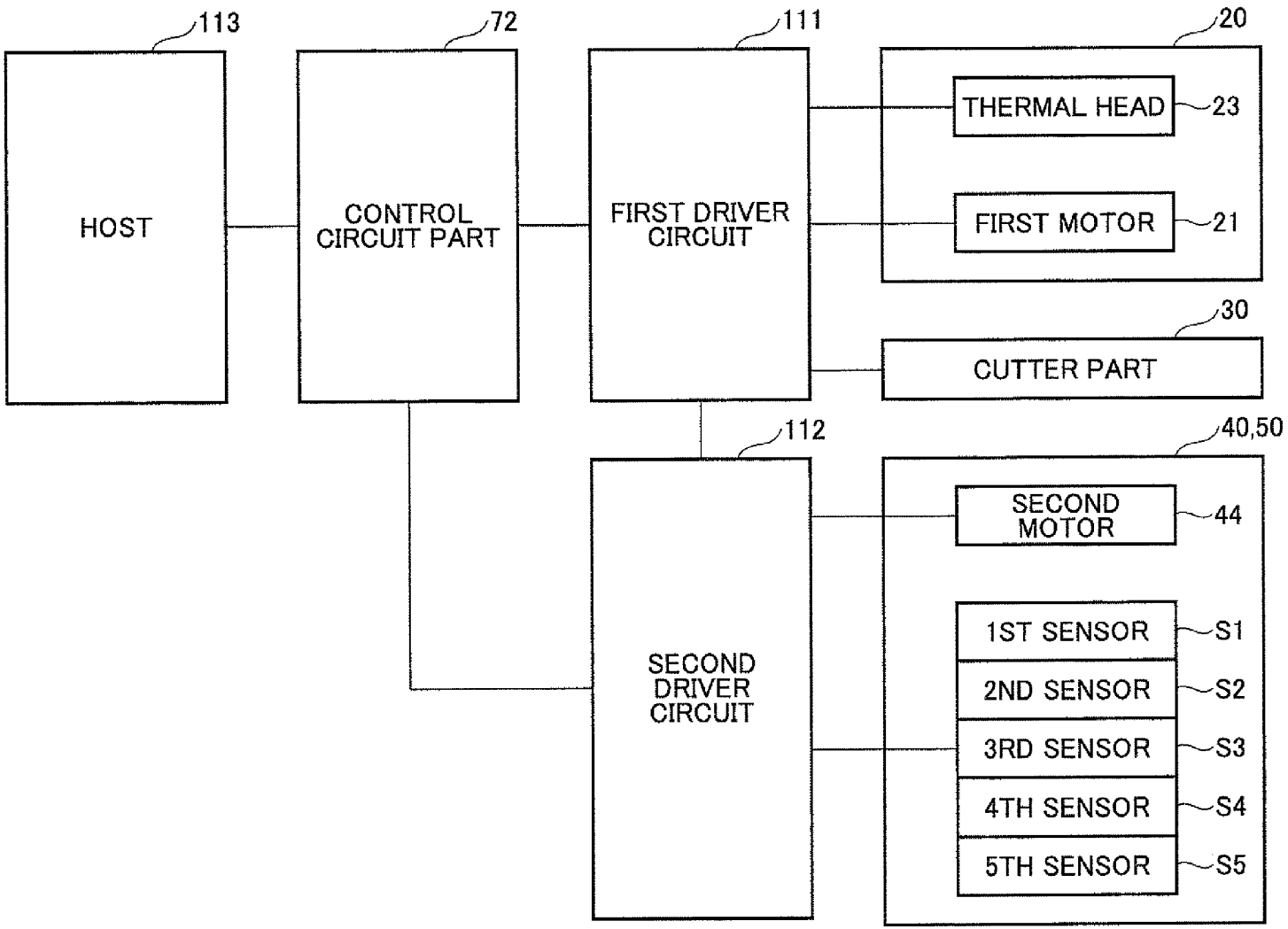
FIG. 15 is a block diagram illustrating a second embodiment of controlling the printer according to the embodiment.

Next, a description is given, with reference to FIG. 15, of a second embodiment of controlling the printer of the above-described embodiment. According to the second embodiment, the printer includes the first driver circuit 111 and the second driver circuit 112. The first driver circuit 111 is configured to drive and control the printing part 20 and the cutter part 30. The second driver circuit 112 is configured to drive and control the presenter unit 40 and the bezel 50. The first driver circuit 111 and the second driver circuit 112 are connected to the control circuit part 72 for controlling the printer according to this embodiment. The control circuit part 72 is connected to the host 113. Accordingly, the first driver circuit 111 and the second driver circuit 112 are controlled based on settings in the host 113 and control in the control circuit part 72.

The first motor 21 and the thermal head 23 of the printing part 20 and the cutter part 30 are connected to and driven and controlled by the first driver circuit 111. The second motor 44, the first sensor S1, the second sensor S2, the third sensor S3, the fourth sensor S4, and the fifth sensor S5 are connected to the second driver circuit 112. The second driver circuit 112 drives and controls the second motor 44. According to this embodiment, the first sensor S1, the second sensor S2, the third sensor S3, the fourth sensor S4, and the fifth sensor S5 may be optical sensors and be configured to determine the presence or absence of the recording paper 10 or the presenter unit 40 based on the presence or absence of reflected light or the amount of light.

Next, a description is given of a method of controlling a printer according to the second embodiment of controlling the printer of the above-described embodiment. In the second embodiment, the first motor 21 and the second motor 44 are stepper motors. Further, the method of controlling a printer according to the second embodiment is carried out based on control executed by the control circuit part 72.

Figure 16:
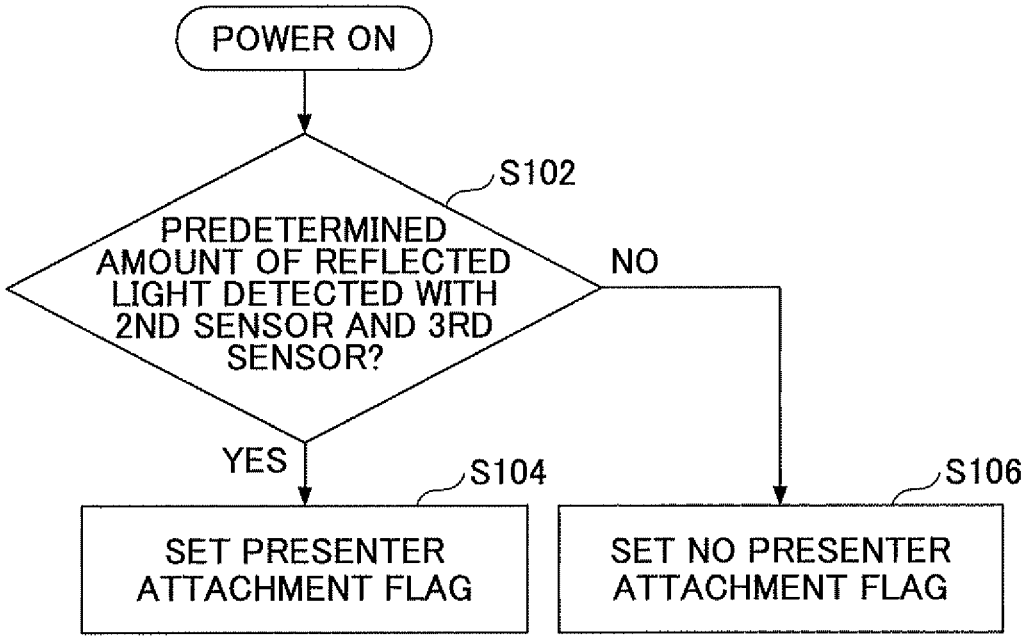
FIG. 16 is a flowchart of a method of controlling the printer according to the second embodiment.

First, as illustrated in FIG. 16, it is determined whether the presenter unit 40 is attached to the bezel 50. For example, after the printer is turned on, in step S102, it is determined with the second sensor S2 and the third sensor S3 whether the presenter unit 40 is attached to the bezel 50. For example, if the second sensor S2 and the third sensor S3 detect (light of) a predetermined amount of reflected light, it is determined that the presenter unit 40 is attached to the bezel 50 (YES in step S102), the process proceeds to step S104. If the second sensor S2 and the third sensor S3 do not detect (light of) a predetermined amount of reflected light, it is determined that the presenter unit 40 is not attached to the bezel 50 (NO in step S102), the process proceeds to step S106. Alternatively, (the presence or absence of) the attachment of the presenter unit 40 to the bezel 50 may be detected by a light-receiving sensor (not graphically illustrated) in the second sensor S2 receiving light emitted from a light-emitting part (not graphically illustrated) in the third sensor S3 and a light-receiving sensor (not graphically illustrated) in the third sensor S3 receiving light emitted from a light-emitting part (not graphically illustrated) in the second sensor S2.

In step S104, a presenter attachment flag is set in the control circuit part 72 or the host 113. That is, it has been determined in step S102 that the presenter unit 40 is attached to the bezel 50 and a presenter attachment flag is set in the control circuit part 72 or the host 113. At this point, the second motor 44 is driven together with the first motor 21 to rotate, being timed to the rotation of the first motor 21.

On the other hand, in step S106, no presenter attachment flag is set in the control circuit part 72 or the host 113. That is, since it has been determined in step S102 that the presenter unit 40 is not attached to the bezel 50, no presenter attachment flag is set in the control circuit part 72 or the host 113.

Thereafter, printing on the recording paper 10 is started. A description is given, with reference to FIG. 17 through FIG. 22, of operations such as conveyance of the recording paper 10 in the printing operation.

Figure 17:
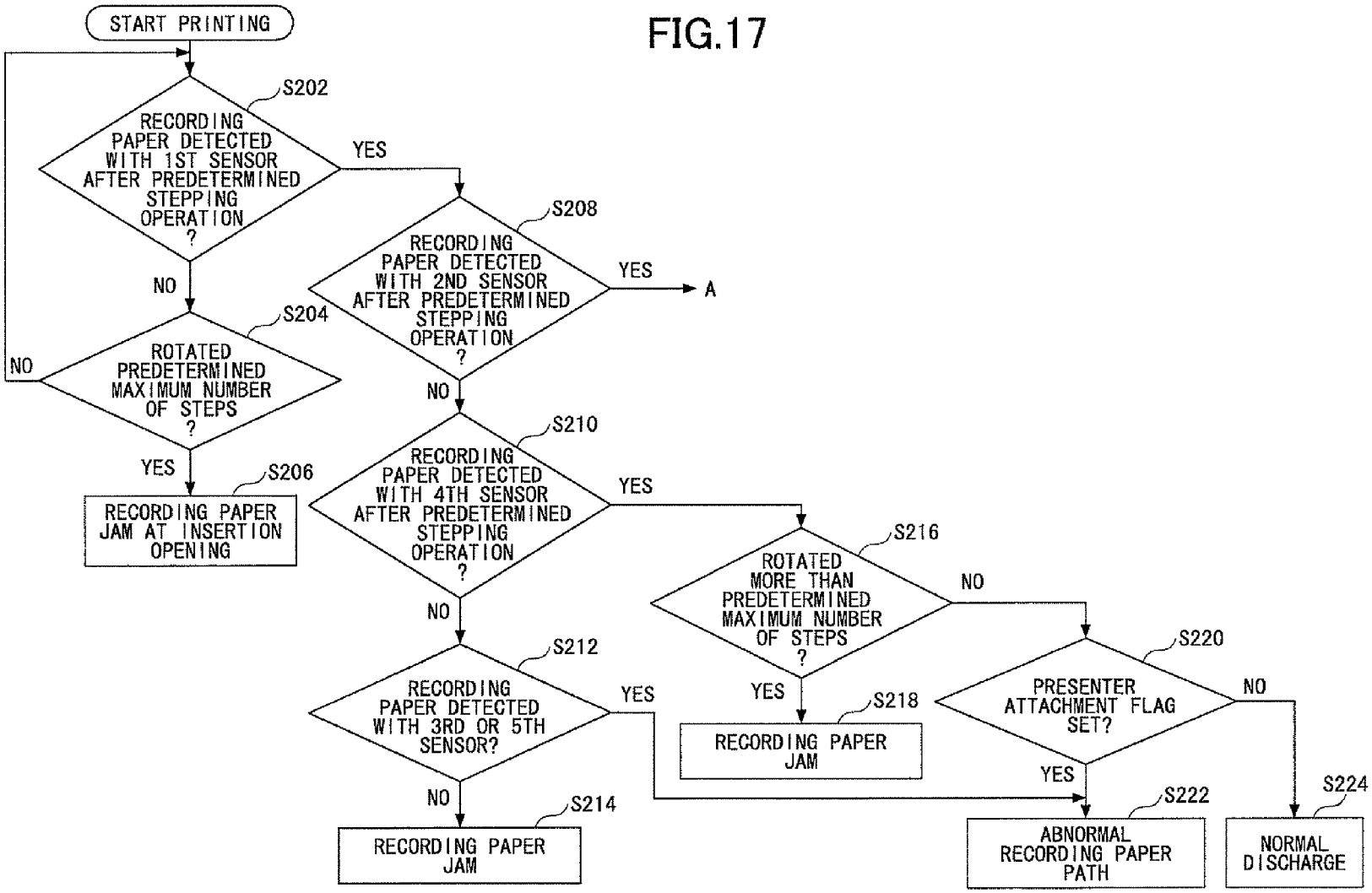
FIG. 17 is another flowchart of the method of controlling the printer according to the embodiment.

First, in step S202 of FIG. 17, after the first motor 21 rotates a predetermined number of steps, it is determined whether the recording paper 10 is detected with the first sensor S1. For example, with the recording paper 10 having entered the bezel 50 and the presenter unit 40 as illustrated in FIG. 5A, the recording paper 10 is detected with the first sensor S1. If it is determined that the recording paper 10 is detected with the first sensor S1 (YES in step S202), the process proceeds to step S208. If it is determined that the recording paper 10 is not detected with the first sensor S1 (NO in step S202), the process proceeds to step S204.

In step S204, it is determined whether the first motor 21 has rotated a predetermined maximum number of steps. The predetermined maximum number of steps in this case is the number of steps in the first motor 21 for feeding the recording paper 10 until the recording paper 10 is detected by the first sensor S1. If the first motor 21 has rotated the predetermined maximum number of steps, normally, the recording paper 10 is supposed to be detected by the first sensor S1. Therefore, if it is determined that the first motor 21 has rotated a predetermined maximum number of steps (YES in step S204), the process proceeds to step S206. On the other hand, if it is determined that the first motor 21 has not rotated a predetermined maximum number of steps (NO in step S204), the process proceeds to step S202, and the first motor 21 further rotates.

In step S206, it is determined that the recording paper 10 is jammed in the insertion opening. In this case, with the first motor 21 and the presenter unit 40 being mounted, the second motor 44 is caused to stop rotating, and a message indicating a paper jam in the insertion opening is displayed in a display part (not graphically illustrated) of the control circuit part 72 or the host 113. For example, in this case, although the recording paper 10 is supposed to have been conveyed by the first motor 21 having rotated a predetermined number of steps, the recording paper 10 is not detected with the first sensor S1. Therefore, the recording paper 10 may be jammed in the entrance opening part 51 of the bezel 50. Therefore, a message to this effect is displayed, and in the case where the first motor 21 and the presenter unit 40 are mounted, the second motor 44 is caused to stop rotating.

In step S208, it is determined whether the recording paper 10 is detected with the second sensor S2. For example, with the recording paper 10 having entered the bezel 50 and the presenter unit 40 as illustrated in FIG. 5A, the recording paper 10 is detected with the second sensor S2. Therefore, if it is determined that the recording paper 10 is detected with the second sensor S2 (YES in step S208), the process proceeds to step S232 of FIG. 18 as indicated by A. On the other hand, if it is determined that the recording paper 10 is not detected with the second sensor S2 (NO in step S208), the process proceeds to step S210.

In step S210, it is determined whether the recording paper 10 is detected with the fourth sensor S4. For example, if the recording paper 10 has entered the paper discharge opening part 52 without entering the presenter unit 40, the recording paper 10 is detected with the fourth sensor S4. Therefore, if it is determined that the recording paper 10 is detected with the fourth sensor S4 (YES in step S210), the process proceeds to step S216. On the other hand, if it is determined that the recording paper 10 is not detected with the fourth sensor S4 (NO in step S210), the process proceeds to step S212.

In step S212, it is determined whether the recording paper 10 is detected with the third sensor S3 or the fifth sensor S5. For example, if the recording paper 10 is detected with the third sensor 53 or the fifth sensor S5 although the recording paper 10 has entered the bezel 50 through the entrance opening part 51, the recording paper 10 may have erroneously entered the paper discharge opening part 52 or the presenter exit part 55. Accordingly, if it is determined that the recording paper 10 is detected with the third sensor S3 or the fifth sensor S5 (YES in step S212), the process proceeds to step S222. On the other hand, if it is determined that the recording paper 10 is not detected with the third sensor S3 or the fifth sensor S5 (NO in step S212), the process proceeds to step S214.

In step S214, it is determined that a paper jam has occurred, and the first motor 21 is caused to stop rotating and a message indicating the occurrence of a paper jam is displayed in the display part (not graphically illustrated) of the host 113 or the control circuit part 72. For example, in this case, although the recording paper 10 is detected with the first sensor S1, the recording paper 10 is not detected with the second sensor S2, the third sensor S3, the fourth sensor S4, or the fifth sensor S5. Therefore, the recording paper 10 may be jammed inside the bezel 50, for example. Accordingly, a message to this effect is displayed, and the first motor 21 is caused to stop rotating.

In step S216, it is determined whether the first motor 21 has rotated more than a predetermined maximum number of steps. The predetermined maximum number of steps in this case is the number of steps in the first motor 21 for feeding the recording paper 10 until the recording paper 10 is detected by the fourth sensor S4. If the first motor 21 has rotated the predetermined maximum number of steps, the recording paper 10 is supposed to be detected by the fourth sensor 34. Therefore, if it is determined that the first motor 21 has rotated a predetermined maximum number of steps (NO in step S216), the process proceeds to step S220. If it is determined that the first motor 21 has rotated more than a predetermined maximum number of steps (YES in step S216), the process proceeds to step S218.

In step S218, it is determined that a paper jam has occurred, and the first motor 21 is caused to stop rotating and a message indicating the occurrence of a paper jam is displayed in the display part (not graphically illustrated) of the host 113 or the control circuit part 72. For example, in this case, although the recording paper 10 is detected with the fourth sensor 34, the first motor 21 has rotated more than required. Therefore, the recording paper 10 may be jammed inside the bezel 50, for example. Accordingly, a message to this effect is displayed, and the first motor 21 is caused to stop rotating.

In step S220, it is determined whether a presenter attachment flag is set. If it is determined that a presenter attachment flag is set (YES in step S220), the process proceeds to step S222. If it is determined that no presenter attachment flag is set (NO in step S220), the process proceeds to step S224. The presenter attachment flag is set based on the amounts of reflected light detected by the second sensor S2 and the third sensor S3 in step S102.

In step S222, it is determined that the recording paper 10 has not followed a predetermined path, and the first motor 21 and the second motor 44 are caused to stop rotating and a message indicating a paper path abnormality is displayed in the display part (not graphically illustrated) of the host 113 or the control circuit part 72. If the presenter unit 40 is attached to the bezel 50, the recording paper 10 is detected with the second sensor S2. However, the recording paper 10 is detected with the fourth sensor S4 without being detected with the second sensor S2. Therefore, the recording paper 10 may have entered a path different from a predetermined path. Accordingly, a message to this effect is displayed, and the first motor 21 and the second motor 44 are caused to stop rotating.

In step S224, the recording paper 10 is normally discharged from the paper discharge opening part 53. If the presenter unit 40 is not attached to the bezel 50, it is determined that the recording paper 10 has followed a normal path. Therefore, the recording paper 10 is normally discharged from the paper discharge opening part 53.

Figure 18:
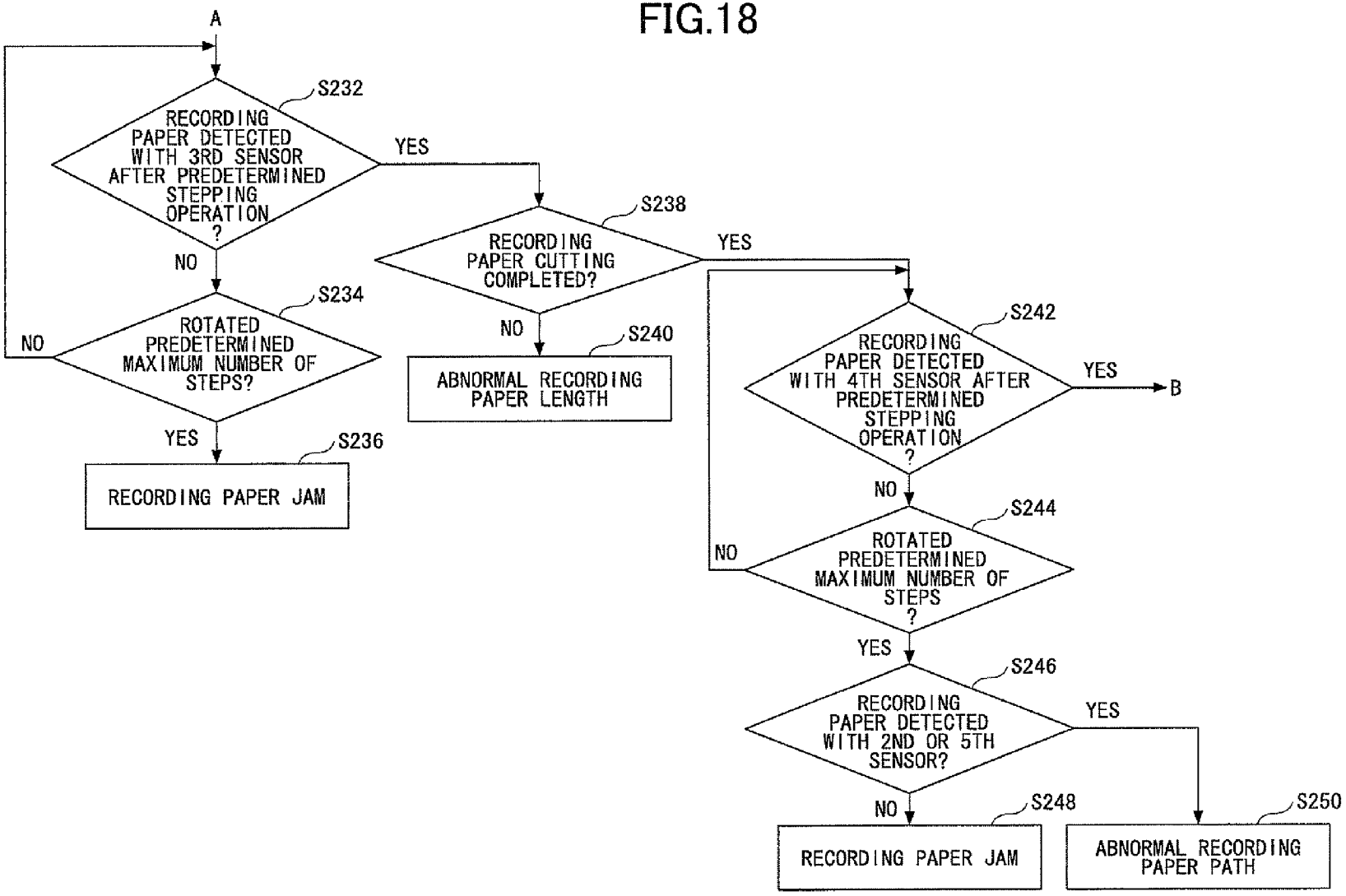
FIG. 18 is another flowchart of the method of controlling the printer according to the embodiment.

Next, a description is given, with reference to FIG. 18, of the case of "NO" in step S208 of FIG. 17 (indicated by A).

First, in step S232, it is determined whether the recording paper 10 is detected with the third sensor S3 after a predetermined stepping operation. For example, as illustrated in FIG. 5B and FIG. 5C, if the recording paper 10 has entered the presenter unit 40 and the second motor 44 has rotated a predetermined number of steps, the recording paper 10 is detected with the third sensor S3. Therefore, if it is determined that the recording paper 10 is detected with the third sensor S3 (YES in step S232), the process proceeds to step S238. On the other hand, if it is determined that the recording paper 10 is not detected with the third sensor S3 (NO in step S232), the process proceeds to step S234.

In step S234, it is determined whether the second motor 44 has rotated a predetermined maximum number of steps. The predetermined maximum number of steps in this case is the number of steps in the second motor 44 for feeding the recording paper 10 until the recording paper 10 is detected by the third sensor S3. If the second motor 44 has rotated the predetermined maximum number of steps, normally, the recording paper 10 is supposed to be detected by the third sensor S3. Therefore, if it is determined that the second motor 44 has rotated more than or equal to a predetermined maximum number of steps (YES in step S234), the process proceeds to step S236. On the other hand, if it is determined that the second motor 44 has not rotated a predetermined maximum number of steps (NO in step S234), the process proceeds to step S232, and the second motor 44 further rotates.

In step S236, it is determined that a paper jam has occurred, and the first motor 21 and the second motor 44 are caused to stop rotating and a message indicating the occurrence of a paper jam is displayed in the display part (not graphically illustrated) of the host 113 or the control circuit part 72. For example, if the recording paper 10 is not detected with the third sensor S3 with the second motor 44 having rotated the predetermined maximum number of steps, the recording paper 10 may be jammed inside the presenter unit 40, for example. Therefore, a message to this effect is displayed, and the first motor 21 and the second motor 44 are caused to stop rotating.

In step S238, it is determined whether the recording paper 10 is cut. For example, as illustrated in FIG. 5C, the recording paper 10 is cut to a predetermined length and discharged. Therefore, if it is determined that the recording paper 10 is cut (YES in step S238), the process proceeds to step S242. On the other hand, if it is determined that the recording paper 10 is not cut (NO in step S238), the process proceeds to step S240.

In step S240, it is determined that there is an abnormality in the length of the recording paper 10, and the first motor 21 and the second motor 44 are caused to stop rotating and a message indicating an abnormality in the length of the recording paper 10 is displayed in the display part (not graphically illustrated) of the host 113 or the control circuit part 72. For example, in this case, the recording paper 10 has not been cut to a predetermined length in the cutter part 30. Therefore, a message to this effect is displayed, and the first motor 21 and the second motor 44 are caused to stop rotating.

In step S242, it is determined whether the recording paper 10 is detected with the fourth sensor S4. For example, as illustrated in FIG. 5C, with the recording paper 10 having entered the presenter unit 40 and being discharged, the recording paper 10 is detected with the fourth sensor S4. Therefore, if it is determined that the recording paper 10 is detected with the fourth sensor S4 (YES in step S242), the process proceeds to step S262 of FIG. 19 as indicated by B in FIG. 18. On the other hand, if it is determined that the recording paper 10 is not detected with the fourth sensor S4 (NO in step S242), the process proceeds to step S244.

In step S244, it is determined whether the second motor 44 has rotated a predetermined maximum number of steps. The predetermined maximum number of steps in this case is the number of steps in the second motor 44 for feeding the recording paper 10 until the recording paper 10 is detected by the fourth sensor S4. If the second motor 44 has rotated the predetermined maximum number of steps, normally, the recording paper 10 is supposed to be detected by the fourth sensor S4. Therefore, if it is determined that the second motor 44 has rotated more than or equal to a predetermined maximum number of steps (YES in step S244), the process proceeds to step S246. On the other hand, if it is determined that the second motor 44 has not rotated a predetermined maximum number of steps (NO in step S244), the process proceeds to step S242, and the second motor 44 further rotates.

In step S246, it is determined whether the recording paper 10 is detected with the second sensor or the fifth sensor S5. For example, if the recording paper 10 is detected with the second sensor S2 or the fifth sensor S5 although the recording paper 10 has entered the bezel 50, the recording paper 10 may have erroneously entered the paper discharge opening part 52 or the presenter entrance part 54. On the other hand, if the recording paper 10 is not detected with the second sensor S2 or the fifth sensor S5, the recording paper 10 may be jammed. Accordingly, if it is determined that the recording paper 10 is detected with the second sensor S2 or the fifth sensor S5 (YES in step S246), the process proceeds to step S250. On the other hand, if it is determined that the recording paper 10 is not detected with the second sensor S2 or the fifth sensor S5 (NO in step S246), the process proceeds to step S248.

In step S248, it is determined that a paper jam has occurred, and the second motor 44 is caused to stop rotating and a message indicating the occurrence of a paper jam is displayed in the display part (not graphically illustrated) of the host 113 or the control circuit part 72. For example, in this case, although the recording paper 10 is detected with the third sensor S3, the recording paper is not detected with the second sensor S2, the fourth sensor S4, or the fifth sensor S5. Therefore, the recording paper 10 may be jammed inside the bezel 50, for example. Accordingly, a message to this effect is displayed, and the second motor 44 is caused to stop rotating.

In step S250, it is determined that the recording paper 10 has not followed a predetermined path, and the second motor 44 is caused to stop rotating and a message indicating a paper path abnormality is displayed in the display part (not graphically illustrated) of the host 113 or the control circuit part 72. For example, if the recording paper 10 is detected with the second sensor S2 or the fifth sensor S5 after the recording paper 10 is cut, the recording paper 10 may have entered a path different from a predetermined path. Accordingly, a message to this effect is displayed, and the second motor 44 is caused to stop rotating.

Figure 19:
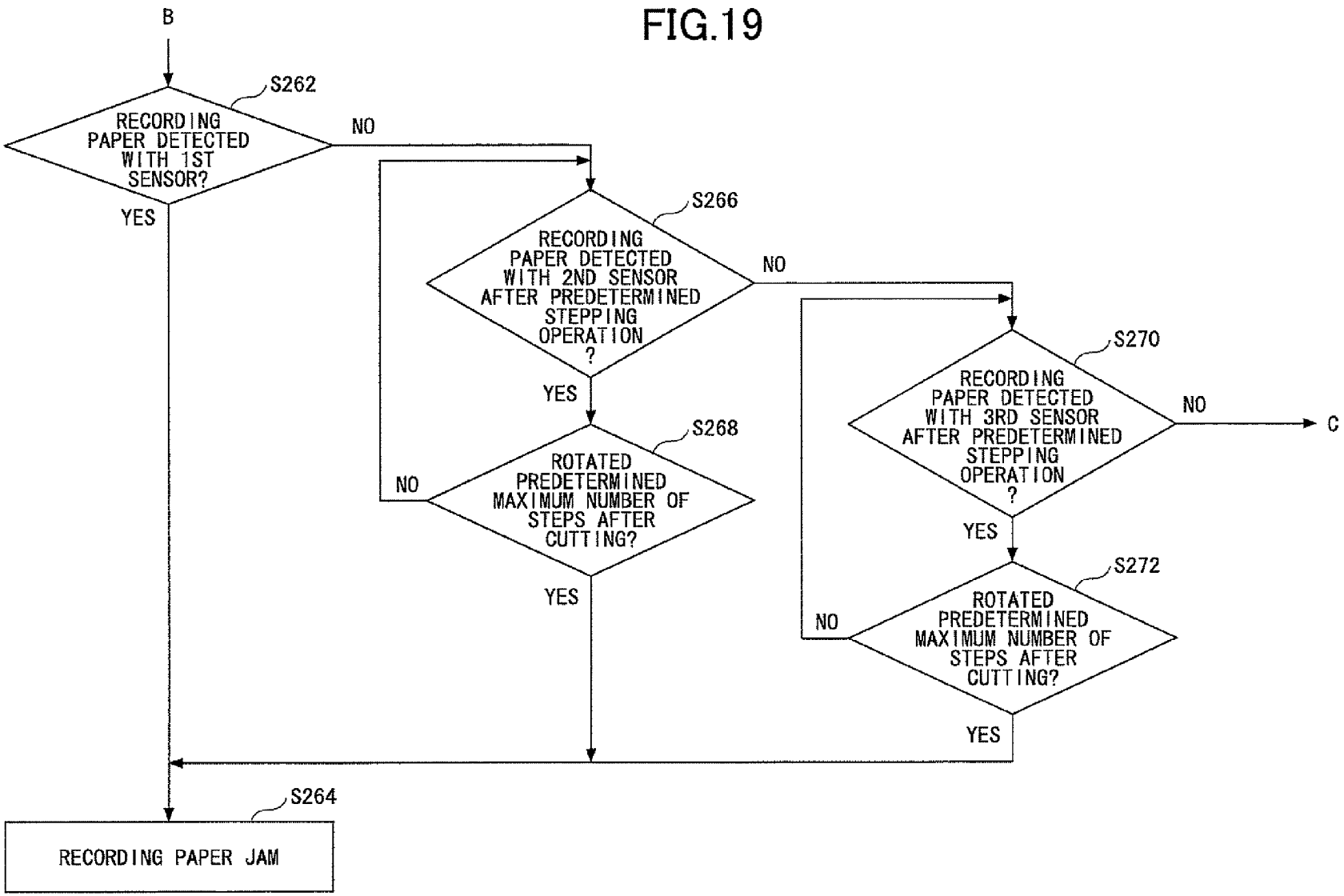
FIG. 19 is another flowchart of the method of controlling the printer according to the embodiment.

Next, a description is given, with reference to FIG. 19, of the case of "YES" in step S242 of FIG. 18 (indicated by B).

First, in step S262, it is determined whether the recording paper 10 is detected with the first sensor S1. For example, with the cut recording paper 10 having entered the presenter unit 40 and thereafter being detected with the fourth sensor S4, the recording paper 10 is not detected by the first sensor S1. Therefore, if it is determined that the recording paper 10 is detected with the first sensor S1 (YES in step S262), the process proceeds to step S264. On the other hand, if it is determined that the recording paper 10 is not detected with the first sensor S1 (NO in step S262), the process proceeds to step S266. In the case where the second motor 44 has not rotated a predetermined number of steps, the second motor 44 further rotates.

In step S264, it is determined that a paper jam has occurred, and the second motor 44 is caused to stop rotating and a message indicating the occurrence of a paper jam is displayed in the display part (not graphically illustrated) of the host 113 or the control circuit part 72. For example, if the recording paper 10 is detected with the first sensor S1 with the second motor 44 having rotated a predetermined number of steps, the recording paper 10 may be jammed inside the bezel 50 or the presenter unit 40, for example. Accordingly, in this case, a message to this effect is displayed, and the second motor 44 is caused to stop rotating.

In step S266, it is determined whether the recording paper 10 is detected with the second sensor S2. For example, as illustrated in FIG. 5C, with the cut recording paper 10 having entered the presenter unit 40 and being discharged, the recording paper 10 is not detected by the second sensor S2. Therefore, if it is determined that the recording paper 10 is detected with the second sensor S2 (YES in step S266), the process proceeds to step S268. On the other hand, if it is determined that the recording paper 10 is not detected with the second sensor S2 (NO in step S266), the process proceeds to step S270.

In step S268, it is determined whether the second motor 44 has rotated a predetermined maximum number of steps after the recording paper 10 is cut. The predetermined maximum number of steps in this case is the number of steps in the second motor 44 for feeding the recording paper 10 until the recording paper 10 is no longer detected by the second sensor S2. If the second motor 44 has rotated the predetermined maximum number of steps, normally, the recording paper 10 is supposed to be no longer detected by the second sensor S2. Therefore, if it is determined that the second motor 44 has rotated more than or equal to a predetermined maximum number of steps (YES in step S268), the process proceeds to step S264. On the other hand, if it is determined that the second motor 44 has not rotated a predetermined maximum number of steps (NO in step S268), the process proceeds to step S266, and the second motor 44 further rotates.

In step S270, it is determined whether the recording paper 10 is detected with the third sensor S3. For example, with the cut recording paper 10 being discharged, the recording paper 10 is not detected with the third sensor S3. Therefore, if it is determined that the recording paper 10 is detected with the third sensor S3 (YES in step S270), the process proceeds to step S272. On the other hand, if it is determined that the recording paper 10 is not detected with the third sensor S3 (NO in step S270), the process proceeds to step S282 of FIG. 20 as indicated by C in FIG. 19.

In step S272, it is determined whether the second motor 44 has rotated a predetermined maximum number of steps after the recording paper 10 is cut. The predetermined maximum number of steps in this case is the number of steps in the second motor 44 for feeding the recording paper 10 until the recording paper 10 is no longer detected by the third sensor S3. If the second motor 44 has rotated the predetermined maximum number of steps, normally, the recording paper 10 is supposed to be no longer detected by the third sensor S3. Therefore, if it is determined that the second motor 44 has rotated more than or equal to a predetermined maximum number of steps (YES in step S272), the process proceeds to step S264. On the other hand, if it is determined that the second motor 44 has not rotated a predetermined maximum number of steps (NO in step S272), the process proceeds to step S270, and the second motor 44 further rotates.

Figure 20:
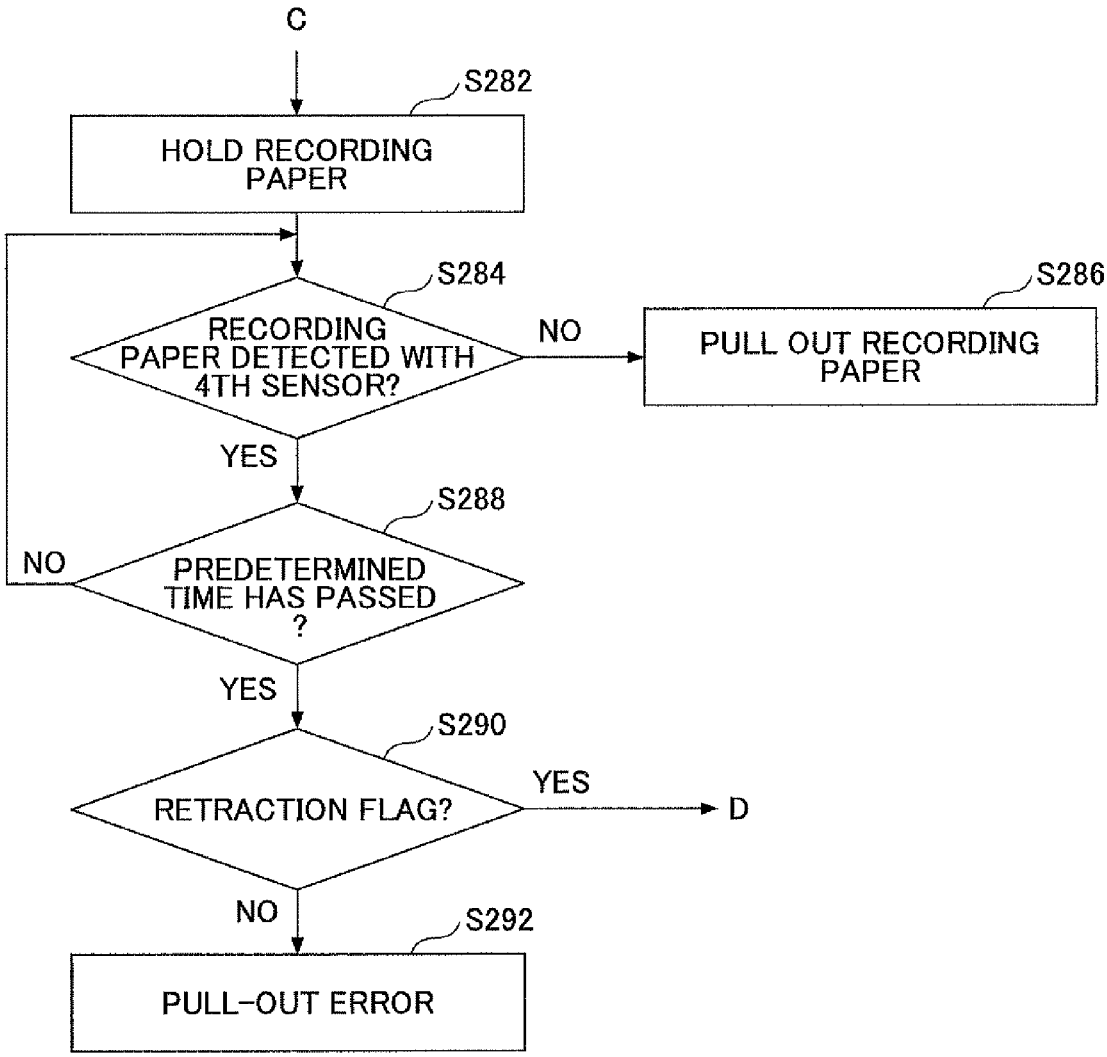
FIG. 20 is another flowchart of the method of controlling the printer according to the embodiment.

Next, a description is given, with reference to FIG. 20, of the case of "NO" in step S270 of FIG. 19 (indicated by C).

First, in step S282, the cut recording paper 10 is held. That is, part of the cut recording paper 10 has stuck out of the paper discharge opening part 53 with the cut recording paper 10 being held between the conveyor belt 42 and the opening door 61 (FIG. 8B). In this state, the recording paper 10 may be manually pulled out.

In step S284, it is determined whether the recording paper is detected with the fourth sensor 54. If the recording paper 10 has been manually pulled out, the recording paper 10 is not detected by the fourth sensor S4. Therefore, if it is determined that the recording paper is detected with the fourth sensor S4 (YES in step S284), the process proceeds to step S288. On the other hand, if it is determined that the recording paper is not detected with the fourth sensor S4 (NO in step S284), the process proceeds to step S286.

In step S286, it is recognized (determined) that the recording paper 10 has been manually pulled out from the paper discharge opening part 53, and the process ends.

In step S288, it is determined whether a predetermined period of time has passed since the start of the state of step S282. For example, if the recording paper 10 has not been pulled out after passage of a predetermined period of time since it is made possible for a person to pull out the recording paper 10, it is believed that the person has no intention to pull out the recording paper 10. Therefore, in this case, the recording paper 10 on which printing has been performed may be retracted in order to protect information recorded on the recording paper 10. Accordingly, if it is determined that a predetermined period of time has passed (YES in step S288), the process proceeds to step S290. On the other hand, if it is determined that a predetermined period of time has not passed (NO in step S288), the process proceeds to step S284.

In step S290, it is determined whether a retraction flag for retracting the recording paper 10 is set. The retraction flag for retracting the recording paper 10 is preset by the host 113 at the stage of initialization. If the retraction flag for retracting the recording paper 10 is set (YES in step S290), the process proceeds to step S302 of FIG. 21 as indicated by D in FIG. 20. On the other hand, if the retraction flag for retracting the recording paper 10 is not set (NO in step S290), the process proceeds to step S292.

In step S292, it is determined that an error has occurred in pulling out the recording paper 10, and a message indicating the occurrence of an error in pulling out the recording paper 10 is displayed in the display part (not graphically illustrated) of the host 113 or the control circuit part 72. For example, in this case, the recording paper 10 remains untaken (not pulled out by a person) and is not retracted. Therefore, a message to this effect is displayed.

Figure 21:
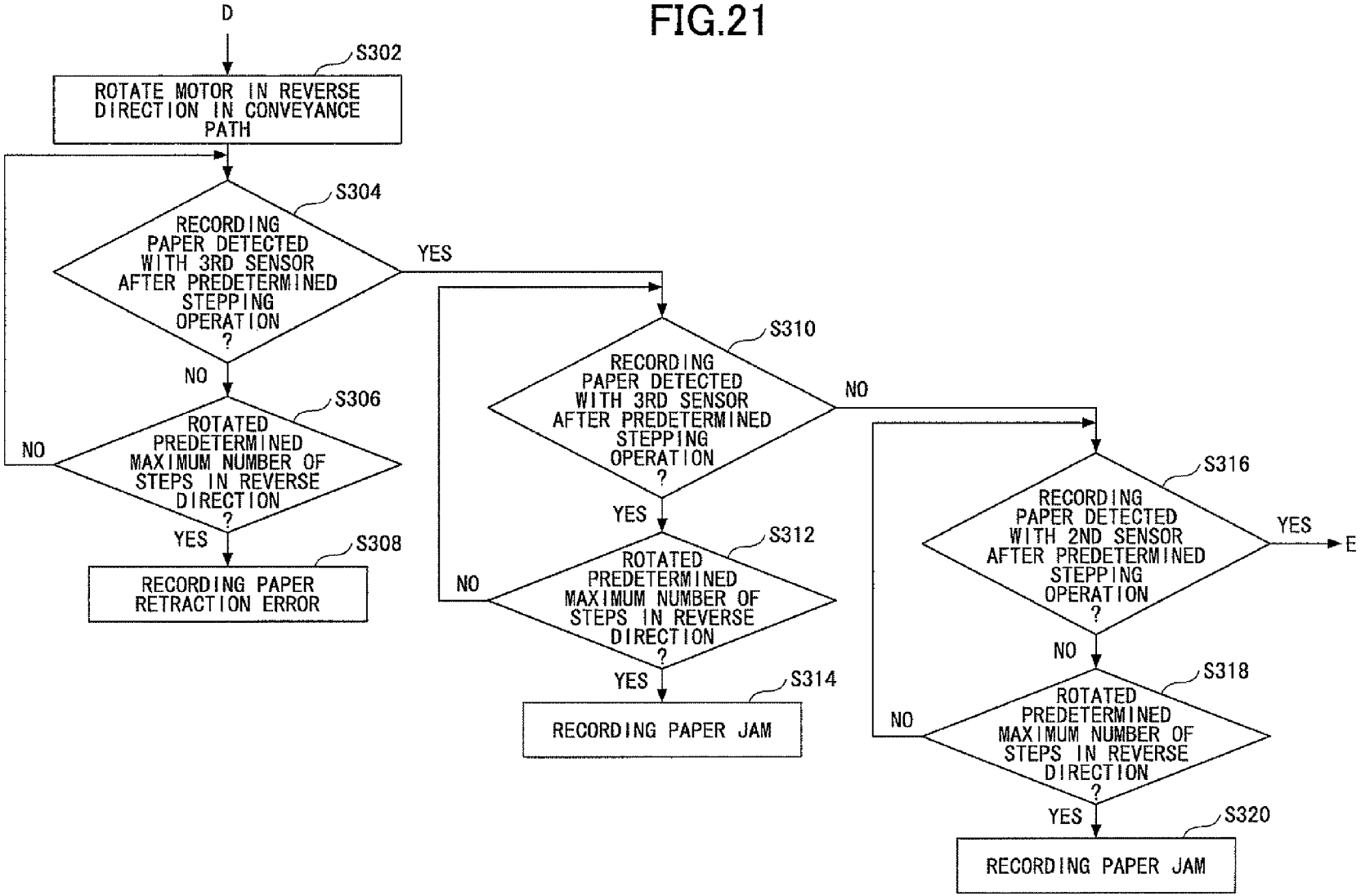
FIG. 21 is another flowchart of the method of controlling the printer according to the embodiment.

Next, a description is given, with reference to FIG. 21, of the case of "YES" in step S290 of FIG. 20 (indicated by D).

First, in step S302, the second motor 44 is caused to rotate in the reverse direction, so that the recording paper 10 is conveyed in the direction opposite to the direction in which the recording paper 10 has been conveyed in the presenter unit 40. For example, the second motor 44 is caused to rotate in the reverse direction in order to retract the recording paper 10.

Next, in step S304, it is determined whether the recording paper 10 is detected with the third sensor S3. For example, when the cut recording paper 10 is conveyed in the opposite direction, first, the recording paper 10 is detected with the third sensor S3. Therefore, if it is determined that the recording paper 10 is detected with the third sensor S3 (YES in step S304), the process proceeds to step S310. On the other hand, if it is determined that the recording paper 10 is not detected with the third sensor S3 (NO in step S304), the process proceeds to step S306.

In step S306, it is determined whether the second motor 44 has rotated a predetermined maximum number of steps after the second motor 44 is caused to rotate in the reverse direction. The predetermined maximum number of steps in this case is the number of steps in the second motor 44 for feeding the recording paper 10, with the recording paper 10 not being detected with the third sensor S3, until the recording paper 10 is detected by the third sensor S3 by the reverse rotation of the second motor 44. If the second motor 44 has rotated the predetermined maximum number of steps in the reverse direction, normally, the recording paper 10 is supposed to be detected by the third sensor S3. Therefore, if it is determined that the second motor 44 has rotated more than or equal to a predetermined maximum number of steps (YES in step S306), the process proceeds to step S308. On the other hand, if it is determined that the second motor 44 has not rotated a predetermined maximum number of steps (NO in step S306), the process proceeds to step S304, and the second motor 44 further rotates in the reverse direction.

In step S308, it is determined that an error has occurred in retracting the recording paper 10, and the second motor 44 is caused to stop rotating and a message indicating the occurrence of an error in retracting the recording paper 10 is displayed in the display part (not graphically illustrated) of the host 113 or the control circuit part 72. That is, if the recording paper 10 is not detected with the third sensor S3 with the second motor 44 having rotated the predetermined maximum number of steps in the reverse direction, the recording paper 10 may not be retracted. Therefore, a message to this effect is displayed, and the second motor is caused to stop rotating.

In step S310, it is determined whether the recording paper 10 is detected with the third sensor S3. For example, if the second motor 44 is caused to rotate in the reverse direction so that the recording paper 10 is detected by the third sensor S3, and then the second motor 44 further rotates in the reverse direction, the recording paper 10 is no longer detected by the third sensor S3. Accordingly, if it is determined that the recording paper 10 is detected with the third sensor S3 (YES in step S310), the process proceeds to step S312. On the other hand, if it is determined that the recording paper 10 is not detected with the third sensor S3 (NO in step S310), the process proceeds to step S316.

In step S312, it is determined whether the second motor 44 has rotated a predetermined maximum number of steps in the reverse direction after the second motor 44 is caused to rotate in the reverse direction. The predetermined maximum number of steps in this case is the number of steps in the second motor 44 for feeding the recording paper 10 until the recording paper 10 is no longer detected by the third sensor S3 by the reverse rotation of the second motor 44. If the second motor 44 has rotated the predetermined maximum number of steps in the reverse direction, normally, the recording paper 10 is supposed to be no longer detected by the third sensor S3. Accordingly, if it is determined that the second motor 44 has rotated more than or equal to a predetermined maximum number of steps in the reverse direction (YES in step S312), the process proceeds to step S314. On the other hand, if it is determined that the second motor 44 has not rotated a predetermined maximum number of steps in the reverse direction (NO in step S312), the process proceeds to step S310, and the second motor 44 further rotates in the reverse direction.

In step S314, it is determined that a paper jam has occurred, and the second motor 44 is caused to stop rotating and a message indicating the occurrence of a paper jam is displayed in the display part (not graphically illustrated) of the host 113 or the control circuit part 72. That is, if the recording paper 10 is detected with the third sensor S3 with the second motor 44 having rotated the predetermined maximum number of steps in the reverse direction, the recording paper 10 may be jammed inside the bezel 50 or the presenter unit 40, for example. Accordingly, in this case, a message to this effect is displayed, and the second motor 44 is caused to stop rotating.

In step S316, it is determined whether the recording paper 10 is detected with the second sensor S2. For example, if the cut recording paper 10 is conveyed in the opposite direction from a state with the recording paper 10 not being detected with the second sensor S2, the recording paper 10 is detected by the second sensor S2. Therefore, if it is determined that the recording paper 10 is detected with the second sensor S2 (YES in step S316), the process proceeds to step S332 of FIG. 22 as indicated by E in FIG. 21. On the other hand, if it is determined that the recording paper 10 is not detected with the second sensor S2 (NO in step S316), the process proceeds to step S318.

In step S318, it is determined whether the second motor 44 has rotated a predetermined maximum number of steps in the reverse direction after the second motor 44 is caused to rotate in the reverse direction. The predetermined maximum number of steps in this case is the number of steps in the second motor 44 for feeding the recording paper 10 until the recording paper 10 is detected by the second sensor S2 by the reverse rotation of the second motor 44 with the recording paper 10 not being detected with the second sensor S2. If the second motor 44 has rotated the predetermined maximum number of steps in the reverse direction, normally, the recording paper 10 is supposed to be detected by the second sensor S2. Accordingly, if it is determined that the second motor 44 has rotated more than or equal to a predetermined maximum number of steps in the reverse direction (YES in step S318), the process proceeds to step S320. On the other hand, if it is determined that the second motor 44 has not rotated a predetermined maximum number of steps in the reverse direction (NO in step S318), the process proceeds to step S316, and the second motor 44 further rotates in the reverse direction.

In step S320, it is determined that a paper jam has occurred, and the second motor 44 is caused to stop rotating and a message indicating the occurrence of a paper jam is displayed in the display part (not graphically illustrated) of the host 113 or the control circuit part 72. That is, if the recording paper 10 is not detected with the second sensor S2 with the second motor 44 having rotated the predetermined maximum number of steps in the reverse direction, the recording paper 10 may be jammed inside the presenter unit 40, for example. Accordingly, in this case, a message to this effect is displayed, and the second motor 44 is caused to stop rotating.

Figure 22:
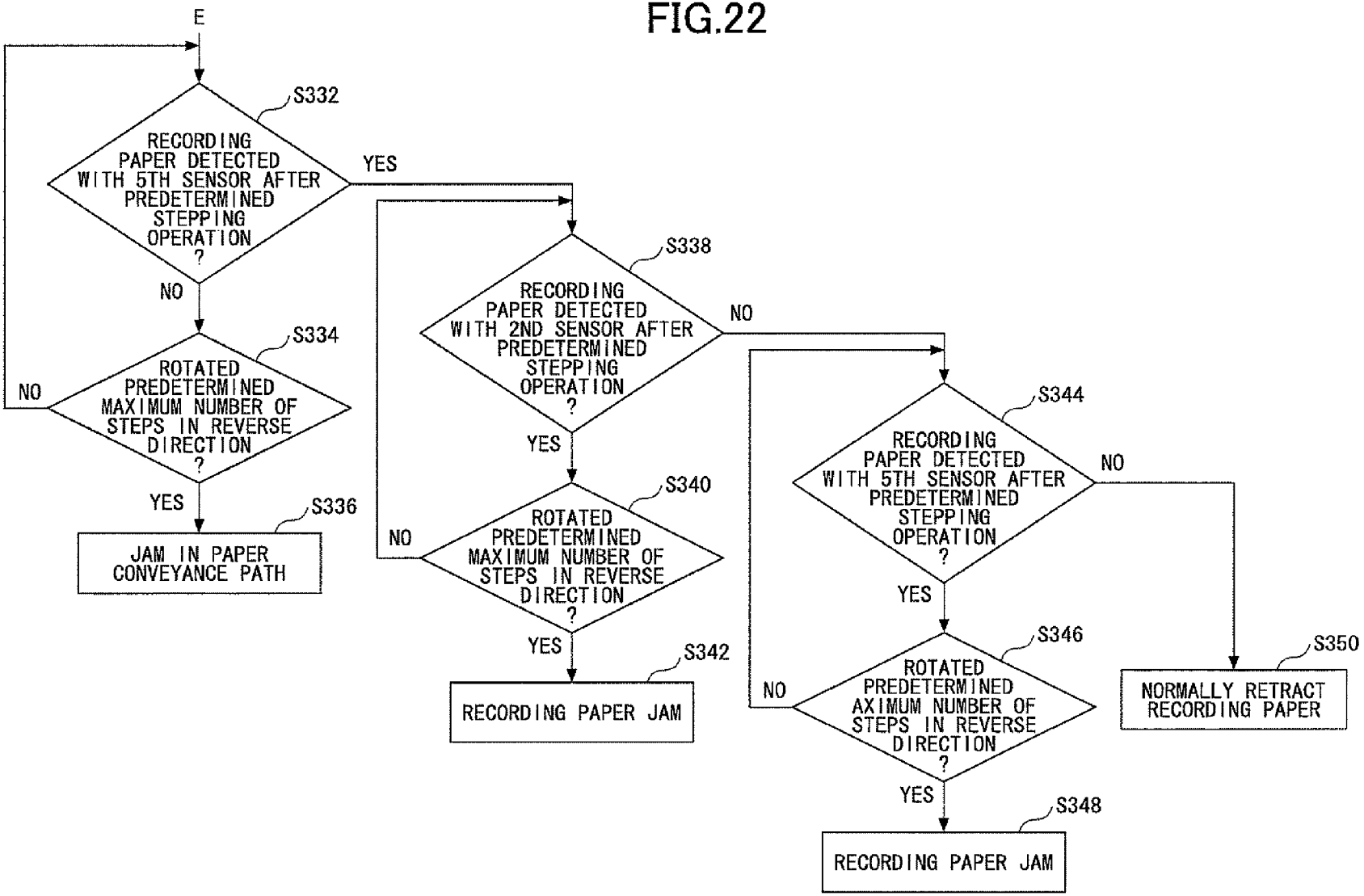
FIG. 22 is another flowchart of the method of controlling the printer according to the embodiment.

Next, a description is given, with reference to FIG. 22, of the case of "YES" in step S316 of FIG. 21 (indicated by E).

First, in step S332, it is determined whether the recording paper 10 is detected with the fifth sensor S5. For example, if the cut recording paper 10 is conveyed in the opposite direction from a state with the recording paper 10 not being detected with the fifth sensor S5, the recording paper 10 is detected by the fifth sensor S5. Therefore, if it is determined that the recording paper 10 is detected with the fifth sensor S5 (YES in step S332), the process proceeds to step S338. On the other hand, if it is determined that the recording paper 10 is not detected with the fifth sensor S5 (NO in step S332), the process proceeds to step S334.

In step S334, it is determined whether the second motor 44 has rotated a predetermined maximum number of steps in the reverse direction after the second motor 44 is caused to rotate in the reverse direction. The predetermined maximum number of steps in this case is the number of steps in the second motor 44 for feeding the recording paper 10, with the recording paper 10 not being detected with the fifth sensor S5, until the recording paper 10 is detected by the fifth sensor S5 by the reverse rotation of the second motor 44. If the second motor 44 has rotated the predetermined maximum number of steps in the reverse direction, normally, the recording paper 10 is supposed to be detected by the fifth sensor S5. Accordingly, if it is determined that the second motor 44 has rotated more than or equal to a predetermined maximum number of steps in the reverse direction (YES in step S334), the process proceeds to step S336. On the other hand, if it is determined that the second motor 44 has not rotated a predetermined maximum number of steps in the reverse direction (NO in step S334), the process proceeds to step S332, and the second motor 44 further rotates in the reverse direction.

In step S336, it is determined that a paper jam has occurred, and the second motor 44 is caused to stop rotating and a message indicating the occurrence of a paper jam is displayed in the display part (not graphically illustrated) of the host 113 or the control circuit part 72. That is, if the recording paper 10 is not detected with the fifth sensor S5 with the second motor 44 having rotated the predetermined maximum number of steps in the reverse direction, the recording paper 10 may be jammed inside the presenter unit 40, for example. Accordingly, in this case, a message to this effect is displayed, and the second motor 44 is caused to stop rotating.

In step S338, it is determined whether the recording paper 10 is detected with the second sensor S2. For example, the recording paper 10 is no longer detected by the second sensor S2 by causing the second motor 44 to rotate in the reverse direction. Therefore, if it is determined that the recording paper 10 is detected with the second sensor S2 (YES in step S338), the process proceeds to step S340. On the other hand, if it is determined that the recording paper 10 is not detected with the second sensor S2 (NO in step S338), the process proceeds to step S344.

In step S340, it is determined whether the second motor 44 has rotated a predetermined maximum number of steps in the reverse direction after the second motor 44 is caused to rotate in the reverse direction. The predetermined maximum number of steps in this case is the number of steps in the second motor 44 for feeding the recording paper 10 until the recording paper 10 is no longer detected by the second sensor S2 by the reverse rotation of the second motor 44. If the second motor 44 has rotated the predetermined maximum number of steps in the reverse direction, normally, the recording paper 10 is supposed to be no longer detected by the second sensor S2. Accordingly, if it is determined that the second motor 44 has rotated more than or equal to a predetermined maximum number of steps in the reverse direction (YES in step S340), the process proceeds to step S342. On the other hand, if it is determined that the second motor 44 has not rotated a predetermined maximum number of steps in the reverse direction (NO in step S340), the process proceeds to step S338, and the second motor 44 further rotates in the reverse direction.

In step S342, it is determined that a paper jam has occurred, and the second motor 44 is caused to stop rotating and a message indicating the occurrence of a paper jam is displayed in the display part (not graphically illustrated) of the host 113 or the control circuit part 72. That is, if the recording paper 10 is detected with the second sensor S2 with the second motor 44 having rotated the predetermined maximum number of steps in the reverse direction, the recording paper 10 may be jammed inside the bezel 50 or the presenter unit 40, for example. Accordingly, in this case, a message to this effect is displayed, and the second motor 44 is caused to stop rotating.

In step S344, it is determined whether the recording paper 10 is detected with the fifth sensor S5. For example, the recording paper 10 is no longer detected by the fifth sensor S5 by causing the second motor 44 to rotate in the reverse direction. Therefore, if it is determined that the recording paper 10 is detected with the fifth sensor S5 (YES in step S344), the process proceeds to step S346. On the other hand, if it is determined that the recording paper 10 is not detected with the fifth sensor S5 (NO in step S344), the process proceeds to step S350.

In step S346, it is determined whether the second motor 44 has rotated a predetermined maximum number of steps in the reverse direction after the second motor 44 is caused to rotate in the reverse direction. For example, the predetermined maximum number of steps in this case is the number of steps in the second motor 44 for feeding the recording paper 10 until the recording paper 10 is no longer detected by the fifth sensor S5 by the reverse rotation of the second motor 44. If the second motor 44 has rotated the predetermined maximum number of steps in the reverse direction, normally, the recording paper 10 is supposed to be no longer detected by the fifth sensor S5. Accordingly, if it is determined that the second motor 44 has rotated more than or equal to a predetermined maximum number of steps in the reverse direction (YES in step S346), the process proceeds to step S348. On the other hand, if it is determined that the second motor 44 has not rotated a predetermined maximum number of steps in the reverse direction (NO in step S346), the process proceeds to step S344, and the second motor 44 further rotates in the reverse direction.

In step S348, it is determined that a paper jam has occurred, and the second motor 44 is caused to stop rotating and a message indicating the occurrence of a paper jam is displayed in the display part (not graphically illustrated) of the host 113 or the control circuit part 72. That is, if the recording paper 10 is detected with the fifth sensor S5 with the second motor 44 having rotated the predetermined maximum number of steps in the reverse direction, the recording paper 10 may be jammed inside the bezel 50 or the presenter unit 40, for example. Accordingly, in this case, a message to this effect is displayed, and the second motor 44 is caused to stop rotating.

In step S350, it is recognized (determined) that the recording paper 10 has been normally retracted through the paper discharge opening part 52, and the process ends.

All examples and conditional language recited herein are intended for pedagogical purposes to aid the reader in understanding the invention and the concepts contributed by the inventors to furthering the art, and are to be construed as being without limitation to such specifically recited examples and conditions, nor does the organization of such examples in the specification relate to a showing of the superiority or inferiority of the invention. Although the embodiments of the present invention have been described in detail, it should be understood that various changes, substitutions, and alterations could be made hereto without departing from the spirit and scope of the invention.

What is claimed is:

1. A printer, comprising:

a printing part configured to perform printing on rolled recording paper;

a presenter unit configured to convey the recording paper for up to a certain length;

a cutter part configured to cut the recording paper subjected to the printing; and a bezel connecting the presenter unit and a printer body part including the printing part and the cutter part, wherein the bezel includes an entrance opening through which the recording paper enters the bezel from the cutter part; and a first paper discharge opening from which the recording paper is to be taken out, and wherein the presenter unit is removably attached to the bezel between the entrance opening and the first paper discharge opening, and wherein a direction in which the presenter unit is attached to the bezel is perpendicular to a path for conveying the recording paper formed between the entrance opening and the first paper discharge opening in the bezel.

2. The printer as claimed in claim 1, wherein the presenter unit includes a conveyor belt, a first gap and a second gap are formed between the bezel and the conveyor belt, the second gap being closer to the printing part than is the first gap, and the recording paper enters the presenter unit through the first gap and exits the presenter unit through the second gap.

3. The printer as claimed in claim 2, wherein the bezel further includes:

a second paper discharge opening from which the recording paper is discharged if the recording paper is untaken from the first paper discharge opening, wherein a direction from the first gap toward the second paper discharge opening is opposite to a direction in which the recording paper enters the presenter unit through the first gap.

4. The printer as claimed in claim 3, wherein the presenter unit is configured to feed the recording paper cut in the cutter part to a position where the recording paper is allowed to be taken out from the first paper discharge opening.

5. The printer as claimed in claim 4, wherein the presenter unit is configured to feed the recording paper fed to said position in a direction opposite to a direction in which the recording paper is fed to said position, and to discharge the recording paper from the bezel through the second paper discharge opening.

6. The printer as claimed in claim 3, wherein:

the presenter unit is attached to a connection part of the bezel between the entrance opening and the first paper discharge opening, and the second paper discharge opening is provided opposite the connection part between the entrance opening and the first paper discharge opening.

7. The printer as claimed in claim 1, wherein the bezel includes a pair of door members in a connection part of the bezel to which the presenter unit is attached.

8. The printer as claimed in claim 7, wherein:

the door members have respective end parts shaped to have an acute angle or overlap with each other, and the door members include a differential mechanism configured to cause one of the end parts to close faster than another one of the end parts.

9. A printer, comprising:

a printing part configured to perform printing on rolled recording paper;

a presenter unit configured to convey the recording paper for up to a certain length; and a cutter part configured to cut the recording paper subjected to the printing, wherein the presenter unit includes a conveyor belt for conveying the recording paper by a rotation of the conveyor belt, wherein the conveyor belt is attached to a first conveying gear and a second conveying gear at a first end and a second end of the conveyor belt, respectively, and the recording paper having entered the presenter unit is wrapped around the conveyor belt at each of the first and second conveying gears while being conveyed.

10. A printer, comprising:

a printing part configured to perform printing on rolled recording paper;

a presenter unit configured to convey the recording paper for up to a certain length;

a cutter part configured to cut the recording paper subjected to the printing; and a bezel connecting the presenter unit and a printer body part including the printing part and the cutter part, wherein the presenter unit is attached to the bezel, and the bezel includes a first sensor configured to detect the recording paper entering the presenter unit, and a second sensor configured to detect the recording paper exiting the presenter unit; the first sensor and the second sensor further configured to detect an attachment of the presenter unit to the bezel.

11. The printer as claimed in claim 10, wherein the bezel further includes:

an entrance opening through which the recording paper enters the bezel from the printer body part; and a third sensor configured to detect the recording paper entering the bezel through the entrance opening.

12. The printer as claimed in claim 11, wherein:

the presenter unit is attached to the bezel so that a first gap through which the recording paper enters the presenter unit and a second gap through which the recording paper exits the presenter unit are formed between the bezel and the presenter unit.

13. The printer as claimed in claim 10, wherein the bezel further includes:

a first paper discharge opening from which the recording paper is taken out; and a fourth sensor configured to detect the recording paper in the first paper discharge opening.

14. The printer as claimed in claim 13, wherein:

the bezel further includes a second paper discharge opening from which the recording paper is discharged if the recording paper is untaken; and a fifth sensor configured to detect the recording paper in the second paper discharge opening, and the presenter unit is configured to feed the recording paper, fed to a position where the recording paper is allowed to be taken out from the first paper discharge opening, in a direction opposite to a direction in which the recording paper is fed to said position, and to discharge the recording paper from the second paper discharge opening.

15. A method of controlling a printer, comprising:

feeding recording paper subjected to printing in a printing part into a bezel through a cutter part and an entrance opening formed in the bezel;

feeding the recording paper fed into the bezel into a presenter unit through a first gap formed between the bezel and a conveyor belt of the presenter unit;

conveying the recording paper fed into the presenter unit for up to a predetermined length by rotating the conveyor belt in a first direction;

cutting the recording paper conveyed for up to the predetermined length by the cutter part;

conveying the cut recording paper toward a first paper discharge opening through a second gap formed between the bezel and the conveyor belt by further rotating the conveyor belt in the first direction, the second gap being closer to the printing part than is the first gap;

stopping the conveyance of the cut recording paper when the cut recording paper is conveyed to a predetermined position; and starting retracting the cut recording paper by rotating the conveyor belt in a second direction reverse to the first direction after passage of a predetermined period of time since the cut recording paper is conveyed to the predetermined position, wherein said retracting includes conveying the cut recording paper in a direction opposite to a direction in which the recording paper has been conveyed to the predetermined position and discharging the cut recording paper from a second paper discharge opening in the bezel through the first gap.

16. The printer as claimed in claim 1, wherein the bezel includes:

a second paper discharge opening from which the recording paper is discharged if the recording paper is untaken from the first paper discharge opening.

* * * * *